US012378827B2

(12) United States Patent
Kunec et al.

(10) Patent No.: US 12,378,827 B2
(45) Date of Patent: Aug. 5, 2025

(54) PIPE HANDLING SYSTEM

(71) Applicant: Nabors Drilling Technologies USA, Inc., Houston, TX (US)

(72) Inventors: Alex Kunec, Conroe, TX (US); Jason Crummel, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 18/660,347

(22) Filed: May 10, 2024

(65) Prior Publication Data

US 2024/0376790 A1 Nov. 14, 2024

Related U.S. Application Data

(60) Provisional application No. 63/501,717, filed on May 12, 2023.

(51) Int. Cl.
*E21B 19/08* (2006.01)
*E21B 19/15* (2006.01)

(52) U.S. Cl.
CPC ..... *E21B 19/08* (2013.01)

(58) Field of Classification Search
CPC ..... E21B 19/08; E21B 19/15; E21B 19/155
See application file for complete search history.

(56) References Cited

U.S. PATENT DOCUMENTS 4,235,566 A * 11/1980 Beeman ..... E21B 19/155 414/598
4,403,898 A * 9/1983 Thompson ..... E21B 19/155 414/22.58
8,764,368 B2 * 7/2014 Crossley ..... E21B 19/14 414/22.57
9,879,442 B2 * 1/2018 Magnuson ..... E21B 19/14
10,907,423 B2 * 2/2021 Ferrari ..... E21B 19/155
11,549,320 B2 * 1/2023 Taggart ..... E21B 19/155
2006/0104746 A1 5/2006 Thompson
2006/0285941 A1 * 12/2006 Fikowski ..... E21B 19/155 414/22.54

(Continued)

FOREIGN PATENT DOCUMENTS

CN 104358533 A * 2/2015 ..... E21B 19/15
GB 2598912 A * 3/2022 ..... E21B 19/15
WO 2024238302 A1 11/2024

OTHER PUBLICATIONS

International Search Report and Written Opinion for PCT/US2024/028708, mailed Oct. 10, 2024, 13 pages.

*Primary Examiner* — Matthew R Buck
(74) *Attorney, Agent, or Firm* — Abel Schillinger, LLP

(57) ABSTRACT

A system can include a base skid with a longitudinal recess, a first end of a lift arm slidably coupled to the base skid, and a carrier configured to transport a tubular and move between a stowed position and a deployed position, where a far end of the carrier is configured to engage a first contoured surface, and where a direction of an inertia of the far end of the carrier is changed in response to engagement with the first contoured surface. A method can include disposing a carrier in a base skid, translating a ramp end along a ramp, translating a far end along the base skid toward the ramp, and engaging the far end with a contoured surface that begins to lift the far end from the base skid.

20 Claims, 29 Drawing Sheets

(56) References Cited

U.S. PATENT DOCUMENTS

| | | | | |
|---|---|---|---|---|
| 2009/0053013 | A1* | 2/2009 | Maltby | E21B 19/15 414/22.61 |
| 2011/0070054 | A1 | 3/2011 | Crossley et al. | |
| 2016/0060980 | A1 | 3/2016 | Magnuson | |
| 2019/0186216 | A1 | 6/2019 | Magnuson et al. | |
| 2019/0376354 | A1 | 12/2019 | McIver et al. | |
| 2020/0123861 | A1 | 4/2020 | Gupta et al. | |

* cited by examiner

VIEW ALONG LINE 11-11

VIEW ALONG LINE 11-11

VIEW ALONG LINE 14-14

VIEW ALONG LINE 14-14

VIEW ALONG LINE 17-17

WIREFRAME VIEW ALONG LINE 17-17

WIREFRAME VIEW ALONG LINE 17-17

WIREFRAME VIEW ALONG LINE 17-17

PIPE HANDLING SYSTEM

CROSS-REFERENCE TO RELATED APPLICATION(S)

This application claims priority under 35 U.S.C. § 119 (e) to U.S. Provisional Application No. 63/501,717, entitled "PIPE HANDLING SYSTEM," by Alex KUNEC et al., filed May 12, 2023, which is assigned to the current assignee hereof and incorporated herein by reference in its entirety.

FIELD OF THE DISCLOSURE

The present invention relates, in general, to the field of drilling and processing of wells. More particularly, present embodiments relate to a system and method for manipulating tubulars during subterranean operations to transfer tubulars between a horizontal storage area and a rig floor.

BACKGROUND

During borehole-forming and completion operations, it is necessary to make up and/or break down long strings of tubular goods such as drill pipe and casing. The string of tubulars may be thousands of feet long, and it can therefore be necessary to transport tubulars (approximately 30 to 45 feet in length) from a horizontal storage area up to the rig floor. When being tripped out of the hole, the tubular string is broken down into separate joints and can be returned to the horizontal storage area.

The handling of oil well tubulars is one of the most dangerous jobs on a drilling rig. Some of the tubulars weigh thousands of pounds, and it is difficult to move the pipe from a horizontal storage area to a vertical position above a well center on the rig. Pipe handlers (such as Catwalks) have been developed to assist in manipulating the tubulars between the well center and the horizontal storage area, yet each of them have built-in inefficiencies and operational hazards. Therefore, improvements in pipe handling systems are continually needed.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One general aspect includes a system for performing a subterranean operation. The system also includes a base skid with a longitudinal recess; and a carrier configured to transport a tubular, where the carrier is configured to move between a stowed position with the carrier being in the longitudinal recess and a deployed position with the carrier being outside of the longitudinal recess, where a far end of the carrier is configured to engage a first contoured surface, and where a direction of an inertia of the far end of the carrier is changed in response to engagement with the first contoured surface. Other embodiments of this aspect include corresponding computer systems, apparatus, and computer programs recorded on one or more computer storage devices, each configured to perform the actions of the methods.

One general aspect includes a method for performing a subterranean operation. The method also includes disposing a carrier in a longitudinal recess in a base skid; translating a ramp end of the carrier along a ramp from the longitudinal recess to a rig floor; translating a far end of the carrier and a lift arm coupled to the carrier along the longitudinal recess toward the ramp; and engaging the far end of the carrier with a first contoured surface, where engaging the first contoured surface begins to lift the far end of the carrier from the longitudinal recess. Other embodiments of this aspect include corresponding computer systems, apparatus, and computer programs recorded on one or more computer storage devices, each configured to perform the actions of the methods.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", "generally", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
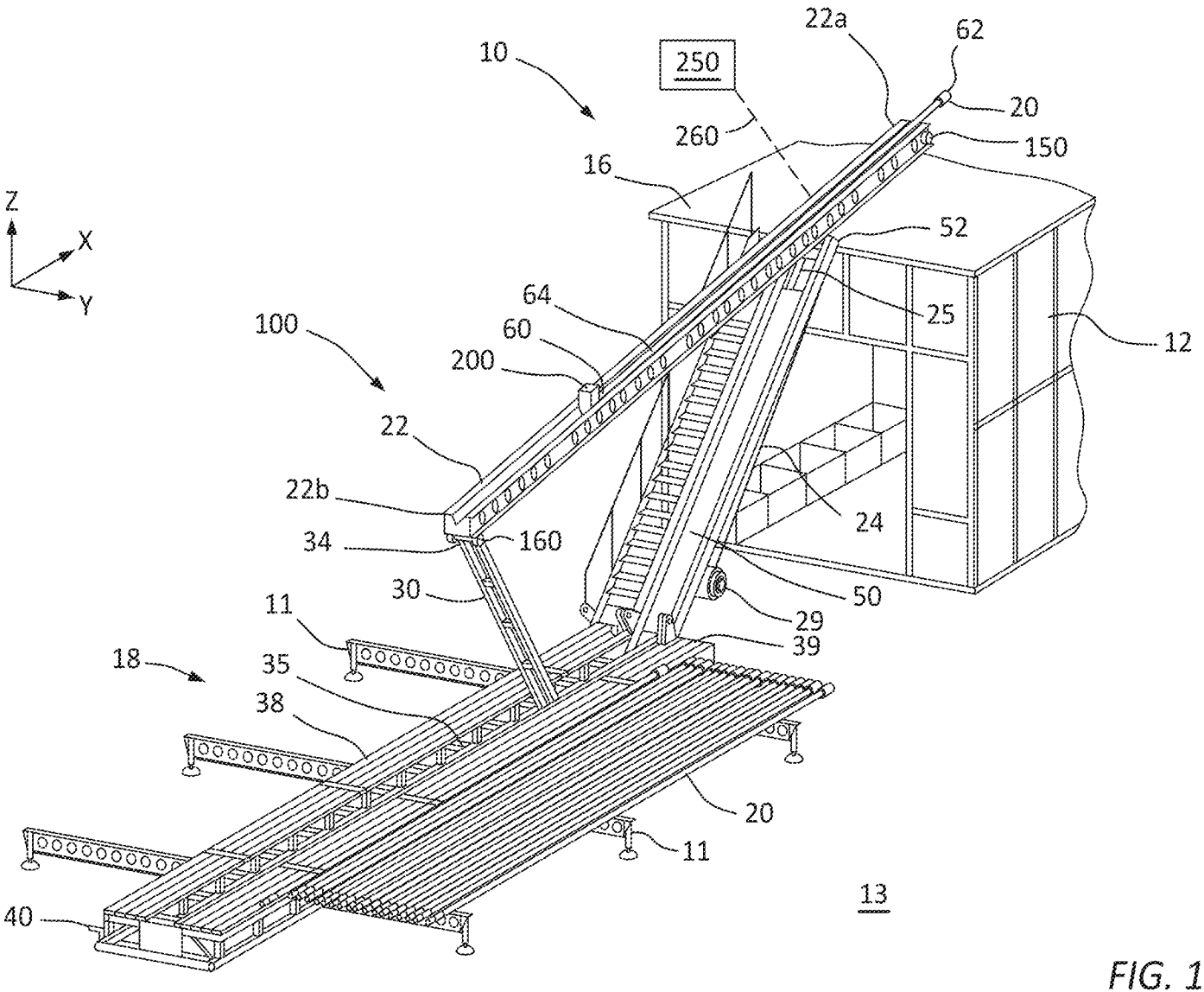
FIG. 1 is a representative perspective view of a pipe handling system installed adjacent a rig, in accordance with certain embodiments.

As used herein, "tubular" refers to an elongated cylindrical tube and can include any of the tubulars manipulated around a rig, such as tubular segments, tubular stands, tubulars, and tubular string, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing string," "coiled tubing", or "wireline."

It should be noted that the X-Y-Z coordinate axes are indicated in at least FIGS. 1, 5A-5C, and 6A-6C, where the X-Y-Z coordinate axes are relative to the base skid 40. The base skid 40 forms an X-Y plane with the Z axis being substantially perpendicular with the base skid 40. As used herein, "horizontal," "horizontal position," or "horizontal orientation" refers to a position that is substantially parallel with the X-Y plane. As used herein, "vertical," "vertical position," or "vertical orientation" refers to a position that is substantially perpendicular relative to the X-Y plane or substantially parallel with the Z axis.

FIG. 1 shows a pipe handling system 100 for conveying pipe between a ground-supported pipe rack 11 (or horizontal storage area 18) and the rig floor 16 of a rig 10. The pipe handling system 100 can include a ramp 50 and a base skid 40 that may include one or more catwalks 38, 39 and a moveable carrier 22. The base skid 40 may be mounted on a ground surface 13 and ramp 50 can interconnect the base skid 40 of the apparatus 10 with a rig floor 16 of the drilling rig. The rig floor 16 can be positioned on a platform 12 of the rig 10. Pipe racks 11 can be positioned adjacent to the base skid 40 to hold a supply of tubulars 20. Tubulars 20 can be passed between the drilling rig 10 and the pipe racks 11 by the pipe handling system 100.

Each tubular 20 can have a pin end 60 that can be positioned near a skate 200 on the carrier 22 when located in the carrier 22, a box end 62 that can be positioned toward the ramp end 22*a* of the carrier 22 when located in the carrier 22, and a body portion 64 that is a portion of the tubular 20 that extends between the pin end 60 and the box end 62. A tubular 20 can be made up of multiple tubular segments, with each segment having a pin end 60, box end 62, and body portion 64 and being threadably connected to each adjacent tubular segments via threading a pin end 60 of one tubular segment into a box end 62 of an adjacent tubular segment.

The pipe handling system 100 includes a drive system for moving the carrier 22 between a lowered (or stowed) position to an elevated (or deployed) position, with the elevated position being shown in FIG. 1. In the following discussion, the term "ramp end" (indicated by 22*a*) refers to the end of the carrier 22 adjacent the ramp 50, while the "far end" (indicated by 22*b*) of the carrier 22 refers to the end of the carrier 22 that is opposite the ramp end 22*a*. In the illustrated embodiment, the drive system may be based on a cable drive that can include a winch 29 for operating the carrier between its stowed and deployed positions. Spaced-apart cables 24 can be roved about upper sheaves 25 and attached between the carrier 22 and the winch 29.

The drive system can include a carrier elevation assembly with a lift arm 30 that is journaled at end 34 adjacent the far end 22*b* of the carrier 22. The carrier 22 and lift arm 30 can ride along a track on the base skid 40 during elevating and lowering of the carrier 22. The track can extend axially along the long axis of the base skid 40 and can provide a support surface so that the assembly of the carrier 22 and the lift arm 30 can move along the track toward and away from the ramp 50.

The track may be positioned in a longitudinally extending, upwardly opening recess 35 for accommodating the carrier 22 with an upper surface of the pipe carrier 22 substantially flush with catwalks 38, 39 when the carrier 22 is in the stowed position (i.e., disposed in the recess 35). Ramp 50 is formed to accept and support the ramp end 22*a* of carrier 22 as it moves thereover between its stowed and deployed positions. Ramp 50 further includes an upper end 52 including a bearing surface capable of supporting movement of the carrier 22 thereover. The ramp end 22*a* of carrier 22 can include opposed rollers 150 that can ride in tracks of the ramp 50. An underside of the carrier 22 can be formed to ride over the upper end 52 when the rollers 150 exit the upper open ends of the tracks, thus allowing extension of the ramp end 22*a* over the rig floor 16.

The equipment of the rig 10, can be communicatively coupled to a rig controller 250 via a network 260, with the network 260 being wired or wirelessly connected to the equipment and other rig resources. It should be understood that the rig controller 250 can at least include one or more processors, non-transitory memory storage that can store data and executable instructions, where the one or more processors are configured to execute the executable instructions, a graphical user interface (GUI), one or more input devices, a display, and a communication link to a remote location. The rig controller 250 can also include processors disposed in the equipment for local control of the equipment or distributed about the rig 10 and pipe handling system 100. Each processor can include non-transitory memory storage that can store data and executable instructions.

Figure 2:
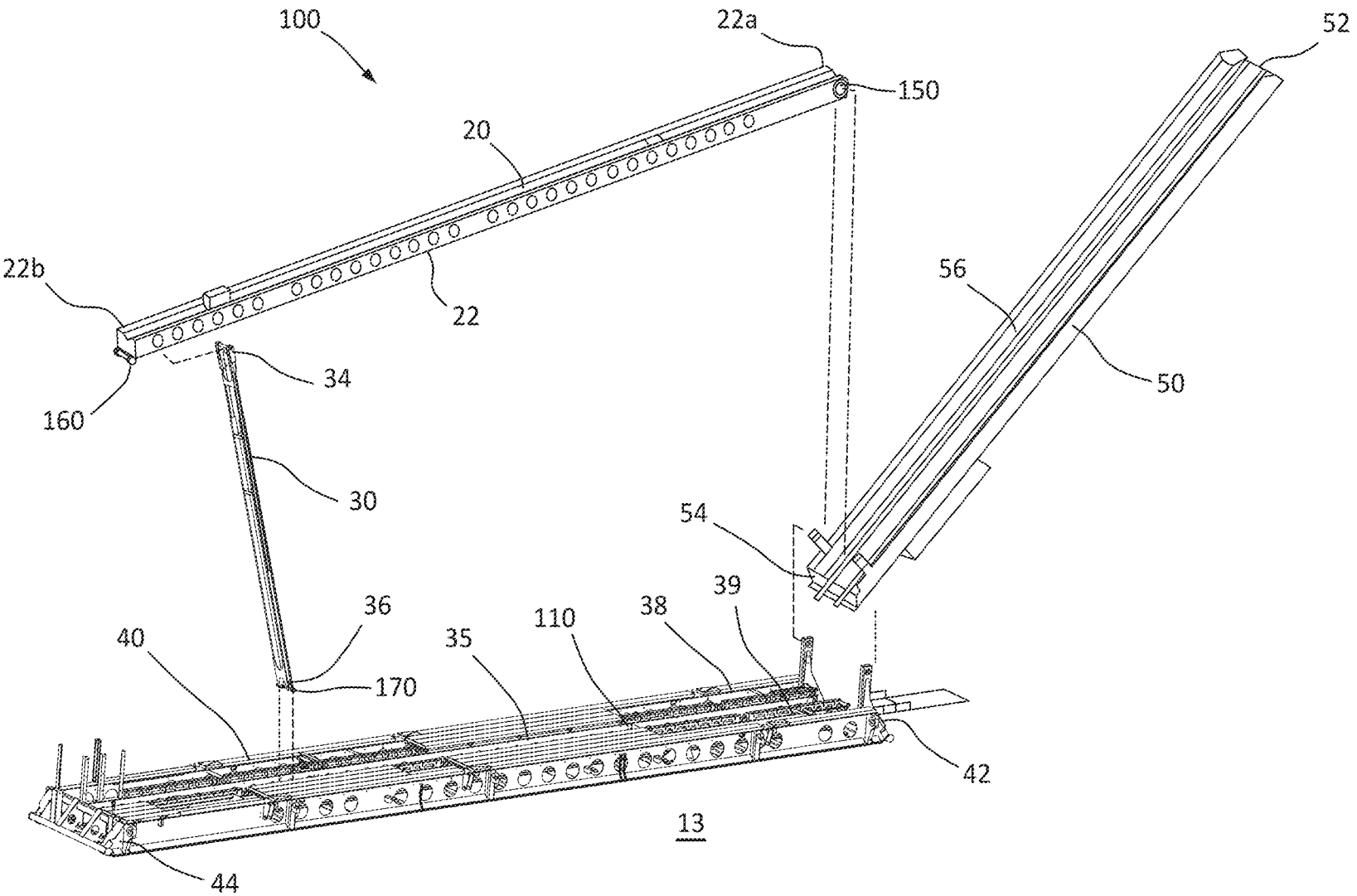
FIG. 2 is a representative exploded view of a pipe handling system, in accordance with certain embodiments.

FIG. 2 is a perspective exploded view of a pipe handling system 100. The base skid 40 can be positioned on a surface of the ground 13 and the base skid 40 can include opposite ends 44, 42, with end 42 being closest to the rig 10 (see FIG. 1). The end 42 can be rotationally attached to the end 54 of the ramp 50, with upper end 52 positioned above a rig floor 16 to facilitate delivery of tubulars 20 from the pipe handling system 100 to the rig floor 16 and vice versa.

In operation, the carrier 22 can receive tubulars 20 from a horizontal storage area 18. In the stowed position, the carrier 22 can be positioned in the recess 35 of the base skid 40 with the lift arm 30 folded up underneath the carrier 22 and also in the recess 35 disposed between the carrier 22 and tracks in the base skid 40. As cables 24 pull the carrier 22 toward the rig floor 16, the ramp end 22*a* can engage the ramp 50 at the end 54 and begin traveling up the ramp 50 as the cables 24 continue to pull the carrier 22. The lift arm 30, which can be rotationally mounted proximate the far end 22*b* at the end 34 of the lift arm 30, can slide along with the far end 22*b* until the lift arm end 36 engages a stop 110 (see also FIG. 3) in the base skid 40.

When the end 36 of the lift arm engages the stop 110, the lift arm 30 can begin to rotate the end 34 out of the recess 35, thereby lifting the far end 22*b* out of the recess 35 and lifting the carrier 22. A contoured surface in the track in the base skid 40 can also engage wheels 160 of the far end 22*b* prior to (or simultaneously with) the lift arm end 36 engaging the stop 110, thereby beginning to lift the far end 22*b* out of the recess 35 prior to (or simultaneously with) the lift arm end 36 engaging the stop 110. Operation of the contoured surface and the stop 110 is described in more detail below. The lift arm 30 can continue to lift the far end 22*b* while the cables 24 continue to pull the ramp end 22*a* along the ramp 50 toward the upper end 52. When the ramp end 22*a* reaches the upper end 52, the ramp end 22*a* can extend over the upper end 52 of the ramp 50 and further over the rig floor 16.

Figure 3:
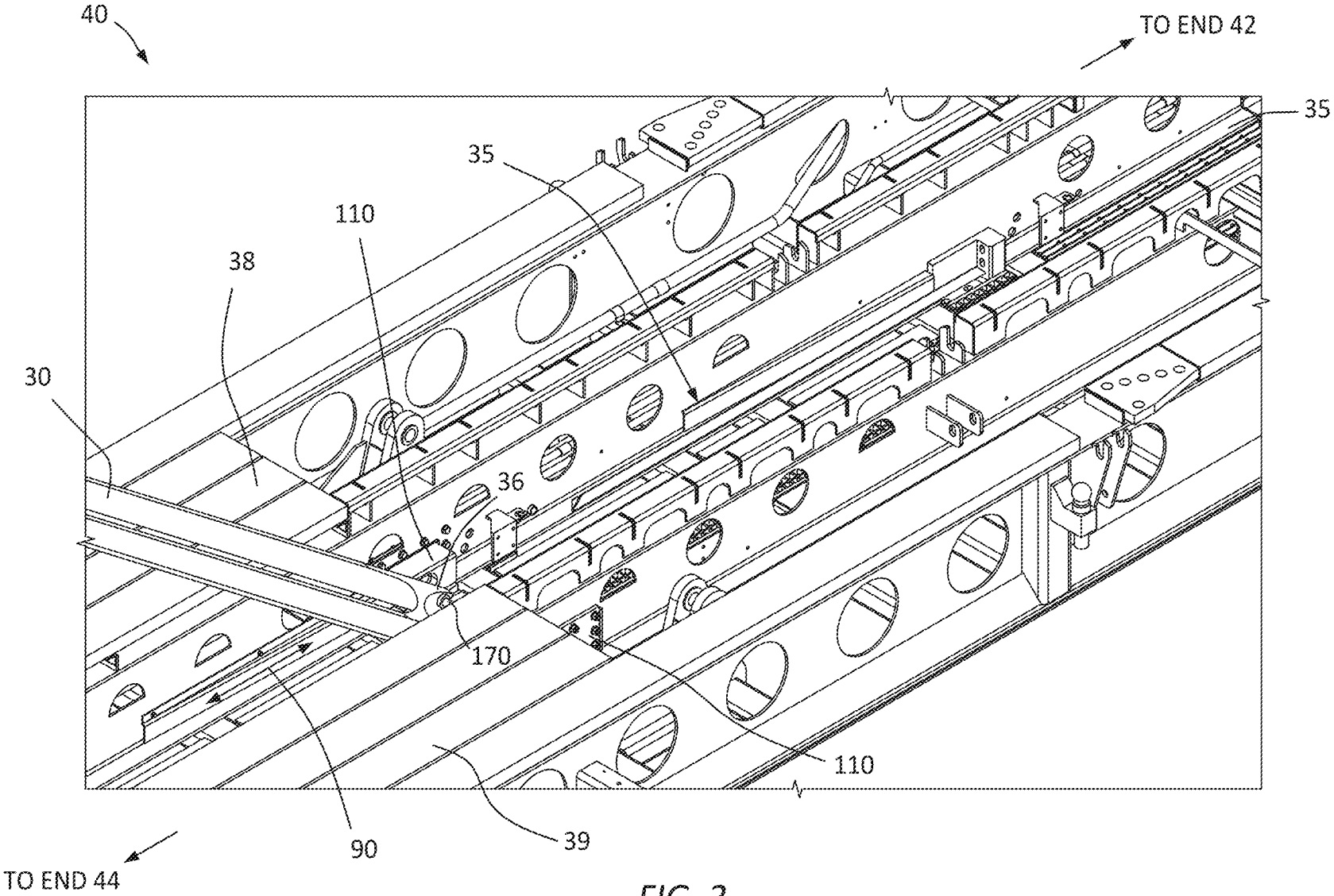
FIG. 3 is a representative perspective view of a pivot connection of a lift arm to a base skid, in accordance with certain embodiments.

FIG. 3 is a representative perspective view of an engagement of the lift arm end 36 to a stop 110 in the base skid 40. This engagement can be referred to as a stop position for the lift arm end 36. As the lift arm end 36 slides through the recess 35 (see arrows 90), the lift arm end 36 can engage the stop 110 and cause the lift arm 30 to begin to rotate out of the recess 35, thereby lifting the far end 22*b* of the carrier 22 out of the recess 35. Stops 110 can be positioned on either side of the recess 35 to capture rollers 170 on the end 36 of the lift arm 30.

Figure 4:
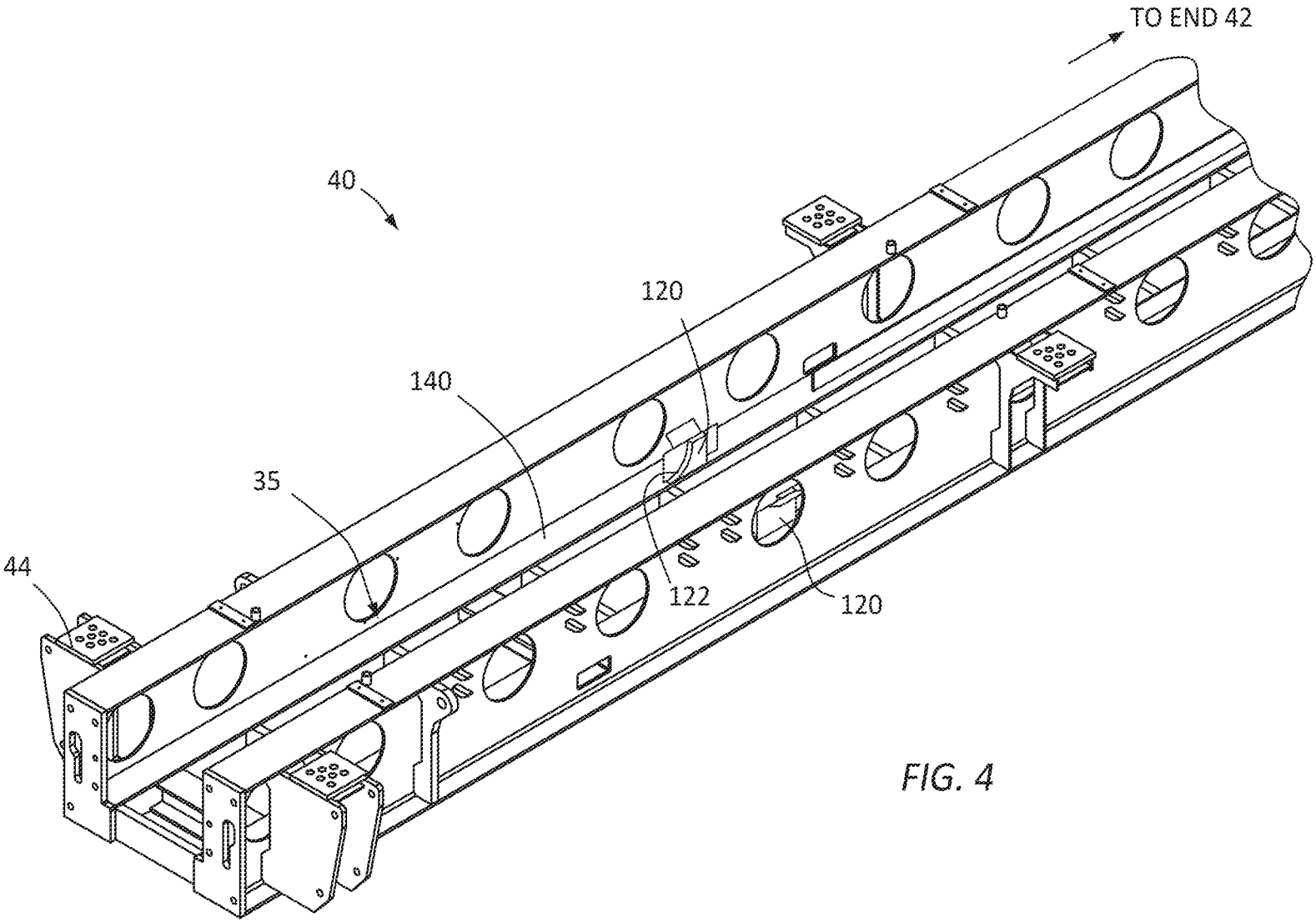
FIG. 4 is a representative perspective view of a far end ramp disposed in a base skid for engaging a far end of a carrier of the pipe handling system, in accordance with certain embodiments.

FIG. 4 is a representative perspective view of a far end ramp 120 disposed in a base skid 40 for engaging a far end 22*b* of the carrier 22, in accordance with certain embodiments. As the carrier 22 (not shown here for clarity) slides in the recess toward the ramp 50, the far end 22*b* of the carrier 22 rolls along a track 140 in the recess 35 until wheels 160 (see FIG. 2) of the far end 22*b* engage a contoured surface 122 of the far end ramp 120. As the carrier 22 is pulled closer to the rig floor 16, the wheels 160 can track the contoured surface 122 of the far end ramp 120, which can cause the far end 22*b* of the carrier to begin lifting vertically from the recess 35. After (or simultaneously when) the wheels 160 track along at least a portion of the contoured surface 122, then the end 36 of the lift arm 30 may engage the stop 110, forcing the lift arm 30 to begin upward rotation from the recess and further lift the far end 22*b* of the carrier 22 from the recess 35.

Figure 5A:
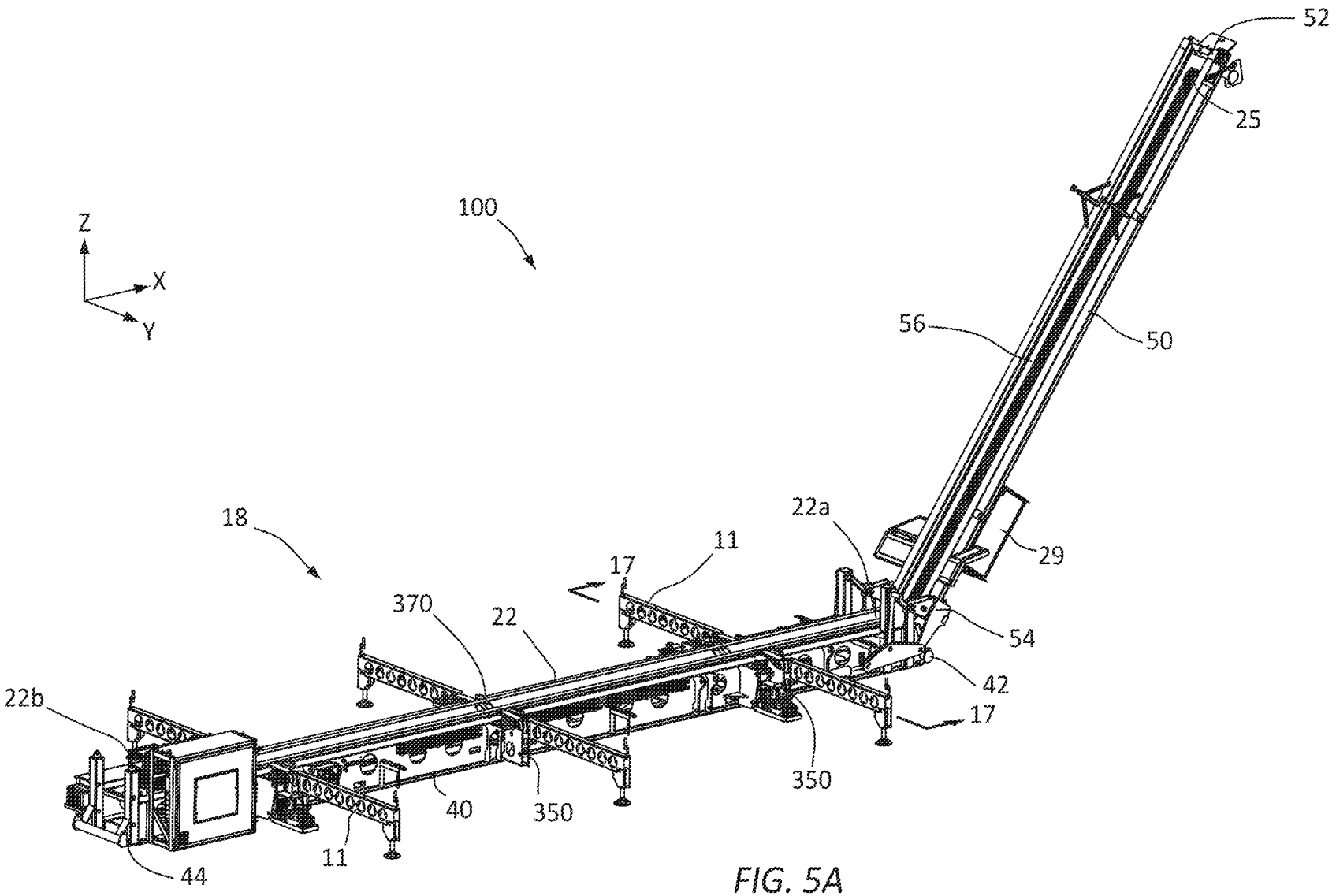
FIG. 5A is a representative perspective view of a pipe handling system with a carrier disposed in a stowed position in a base skid, in accordance with certain embodiments.
Figure 5B:
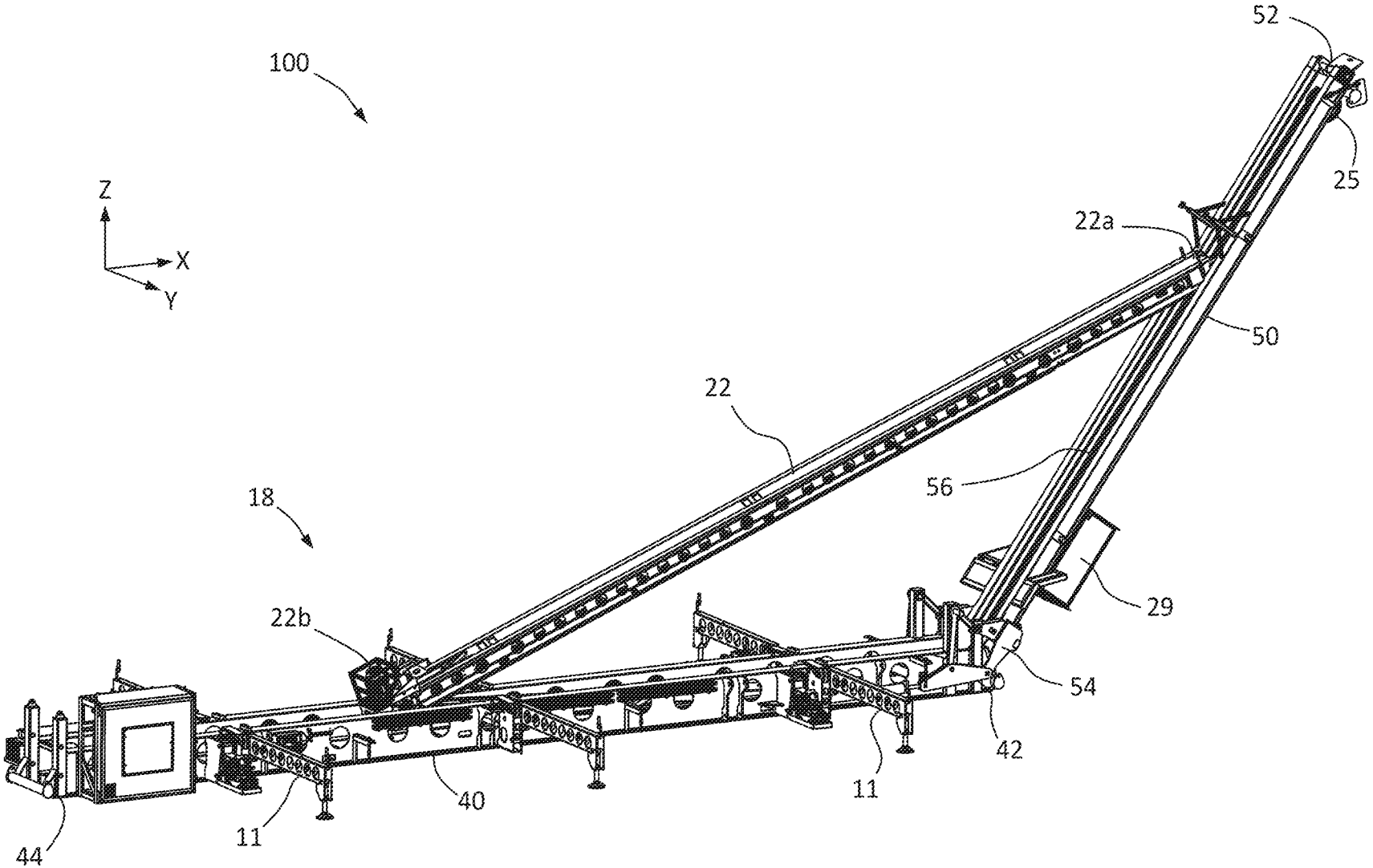
FIG. 5B is a representative perspective view of a pipe handling system having a carrier in a partially deployed position with a ramp end of the carrier disposed along a track on an inclined ramp and a far end of the carrier disposed on a track in a base skid, in accordance with certain embodiments.
Figure 5C:
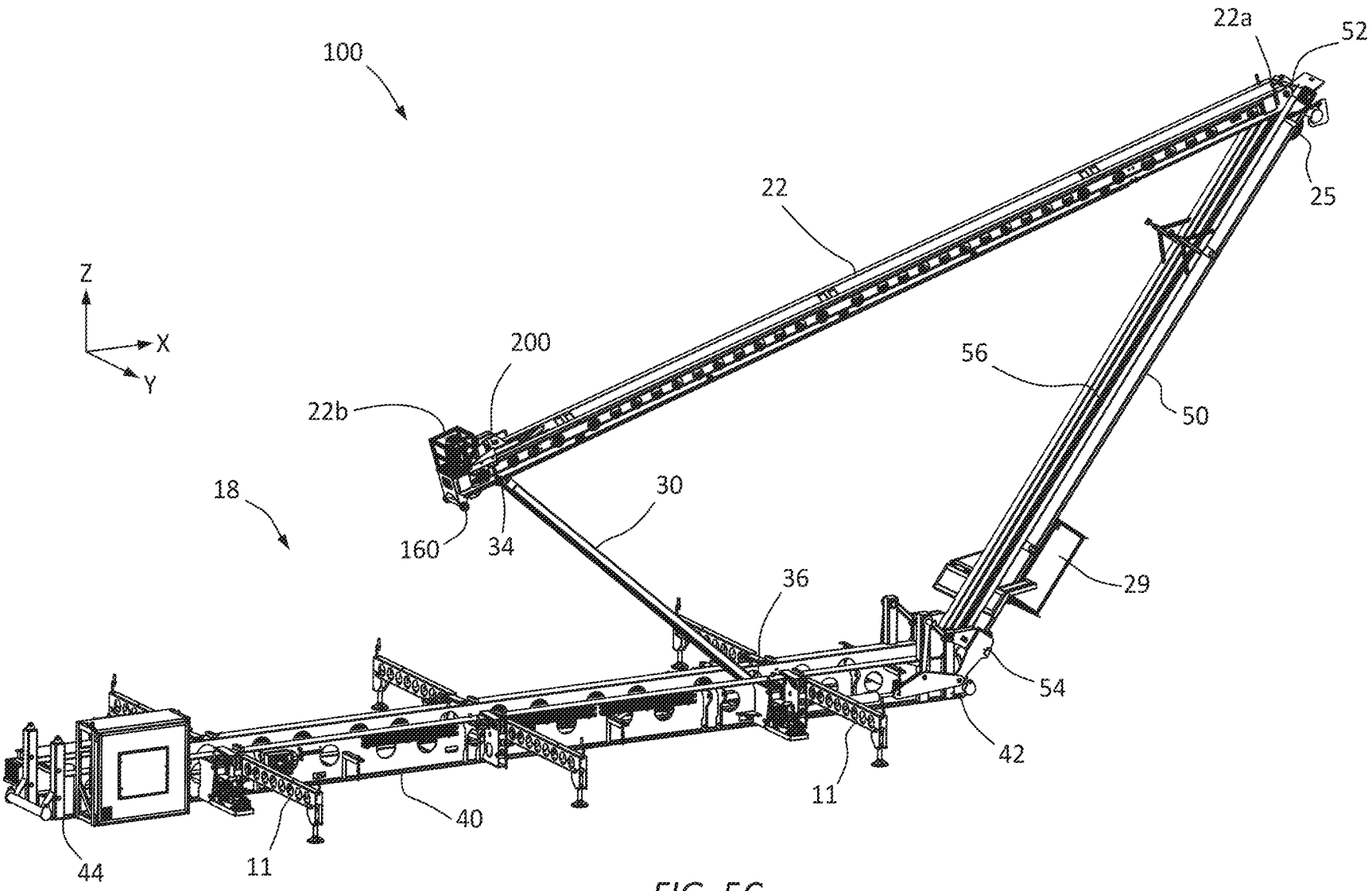
FIG. 5C is a representative perspective view of a pipe handling system having a carrier in a partially deployed position with a ramp end of the carrier disposed along a track at an upper end of an inclined ramp and a far end of the carrier lifted from the base skid by a lift arm, in accordance with certain embodiments.
Figure 5D:
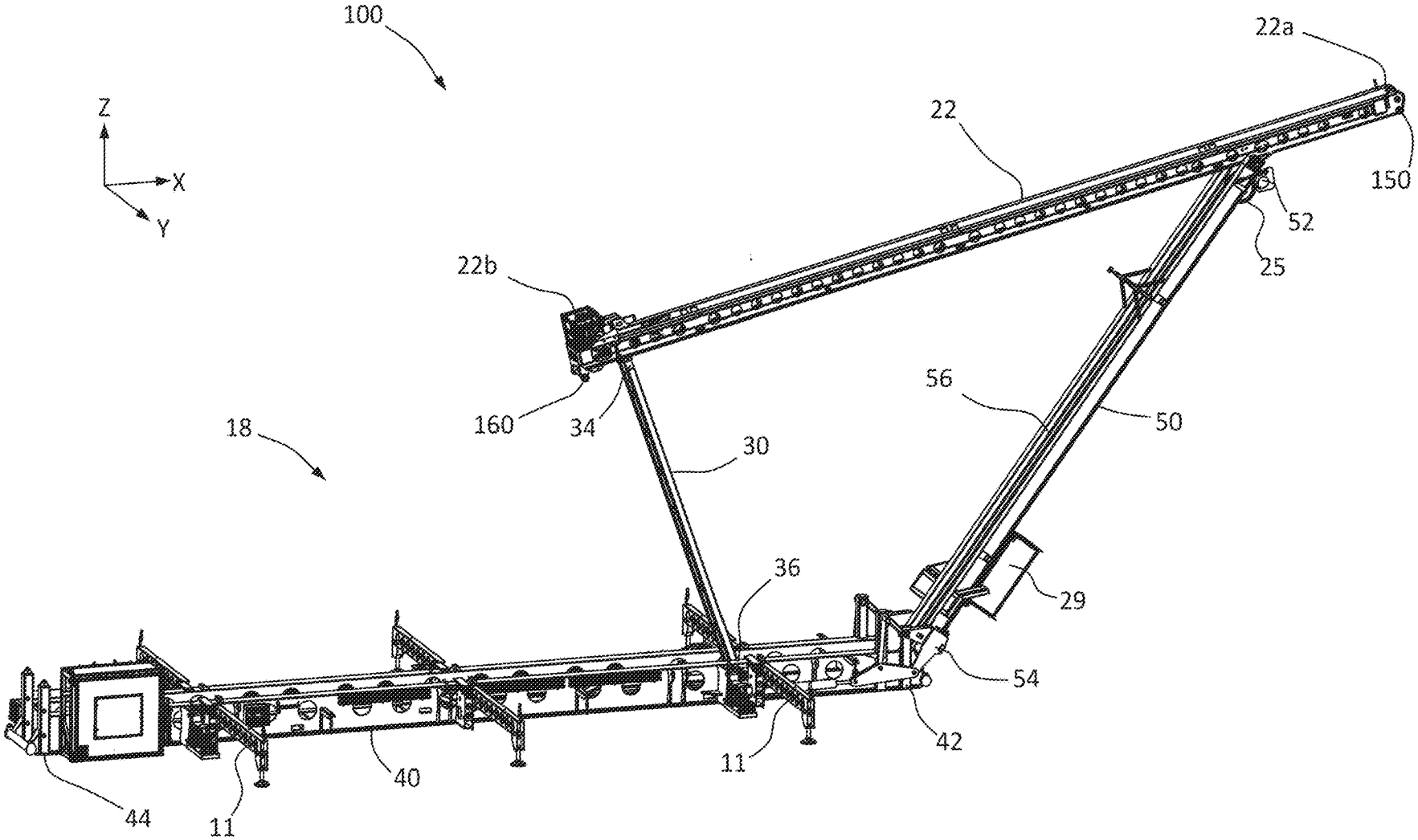
FIG. 5D is a representative perspective view of a pipe handling system having a carrier in a fully deployed position with a ramp end of the carrier extending toward a well center from an upper end of an inclined ramp and a far end of the carrier lifted further from the base skid by a lift arm, in accordance with certain embodiments.

FIGS. 5A-5D show a progression of the carrier 22 from its stowed position in the recess 35 (FIG. 5A), to a partially deployed position where the wheels 160 have engaged with the contoured surface 122 of the far end ramp 120 and the lift arm 30 has engaged the stop 110 in the recess 35 (FIG. 5B), to a partially deployed position where the far end 22*b* has been lifted from the recess 35 and the ramp end 22*a* has reached the upper end 52 of the ramp 50 (FIG. 5C), and to the fully deployed position where the ramp end 22*a* extends past the upper end 52 to be positioned over the rig floor 16 to present a tubular 20 to the well center (FIG. 5D). The progression shown in FIGS. 5A-5D can be reversed to transfer a tubular 20 from the rig floor 16 to the horizontal storage area 18.

FIG. 5A is a representative perspective view of a pipe handling system 100 with a carrier 22 disposed in a stowed position in the base skid 40, in accordance with certain embodiments. Indexers 350 can be used to tip a tubular 20 from the pipe racks 11 into a longitudinal V-groove 26 (see FIGS. 7 and 8) of the carrier 22. When moving tubulars 20 from the longitudinal V-groove 26 to the pipe racks 11, kickers 370 can be used to push the tubular 20 from the longitudinal V-groove 26.

FIG. 5B is a representative perspective view of a pipe handling system 100 having a carrier 22 in a partially deployed position with a ramp end 22*a* of the carrier 22 disposed along a track 56 of an inclined ramp 50 and a far end 22*b* of the carrier 22 disposed on the track 140 (see FIG. 4) in a base skid 40, in accordance with certain embodiments. At this point the winch 29 (via cables 24 not shown) has pulled the ramp end 22*a* at least partially up the ramp 50 and the far end 22*b* has been moved along the track 140 where the wheels have engaged with the contoured surfaces 122 of the far end ramps 120. As the far end 22*b* begins to be lifted from recess 35 due to the engagement of the wheels 160 with the contoured surface 122, the end 36 of the lift arm 30 can engage the stop 110 in recess 35. The engagement of stop 110 causes upward rotation of the lift arm 30 because the end 36 is prevented from moving further along the recess 35 as the carrier 22 is pulled further up the ramp 50.

FIG. 5C is a representative perspective view of a pipe handling system 100 having a carrier 22 in a partially deployed position with a ramp end 22*a* of the carrier 22 disposed along a track 56 to an upper end 52 of an inclined ramp 50 and a far end 22*b* of the carrier 22 lifted from the base skid 40 by a lift arm 30, in accordance with certain embodiments. At this partially deployed position, the end 36 remains engaged with the stop 110, and the lift arm 30 is further rotated upward, thereby further raising the far end 22*b* as the cables 24 continue to pull the carrier 22 toward the rig floor 16 (see FIG. 1). The ramp end 22*a* has reached the end of the tracks 56 (on which the rollers 150 were rolling) and begins to extend the ramp end 22*a* past the upper end 52 toward well center on the rig floor 16.

FIG. 5D is a representative perspective view of a pipe handling system 100 having a carrier 22 in a fully deployed position with a ramp end 22*a* of the carrier 22 extending toward a well center from an upper end 52 of an inclined ramp 50 and a far end 22*b* of the carrier 22 lifted further from the base skid 40 by a lift arm 30, in accordance with certain embodiments. At this fully deployed position, the end 36 remains engaged with the stop 110, and the lift arm 30 is further rotated upward, thereby further raising the far end 22*b* as the cables 24 continue to pull the carrier 22 toward the well center of the rig floor 16 (see FIG. 1). The ramp end 22*a* has been extended a desired distance past the upper end 52 and is positioned to deliver the tubular 20 to another pipe handler (vertical pipe handler, top drive, elevator, drill floor robot, etc.) at the well center on the rig floor 16. The skate 200, that is slidably coupled to the carrier 22, can engage a far end (e.g., a pin end 60) of the tubular 20 and slide the tubular 20 along the longitudinal V-groove 26 of the carrier 22 until the opposite end (e.g., a box end 62) of the tubular 20 is presented to the other pipe handler proximate a well center.

Figure 6A:
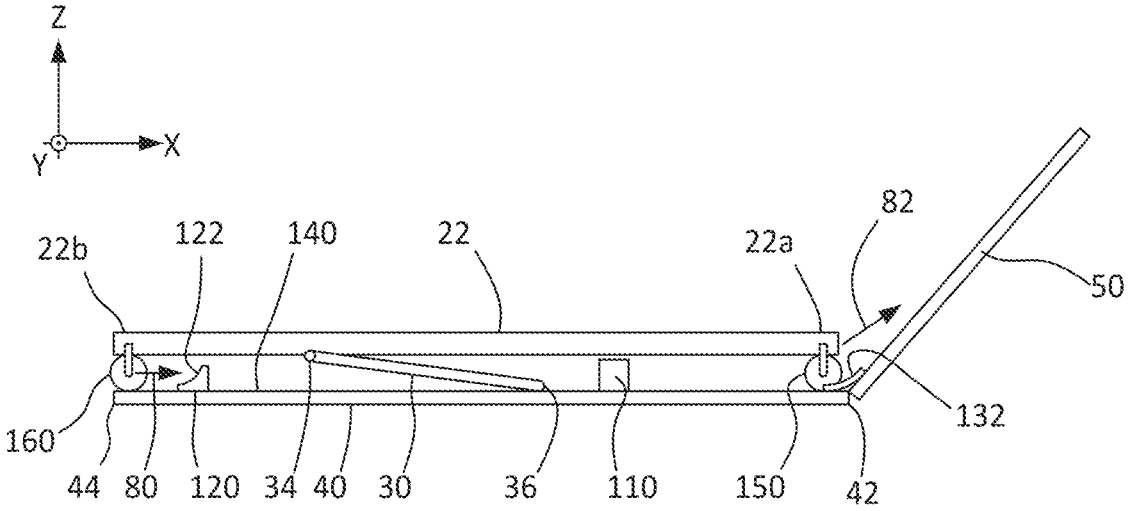
FIG. 6A is a representative simplified functional side view of a pipe handling system with a carrier disposed in a stowed position in the base skid, in accordance with certain embodiments.
Figure 6B:
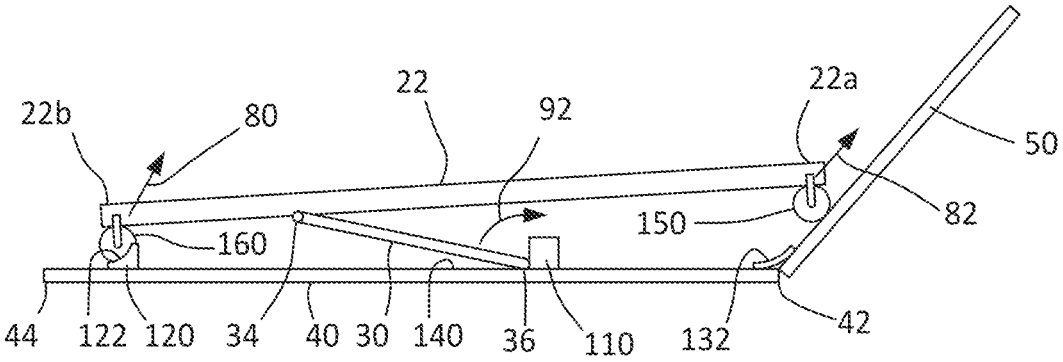
FIG. 6B is a representative simplified functional side view of a pipe handling system having a carrier in a partially deployed position with a ramp end of the carrier disposed along a track on an inclined ramp and a far end of the carrier disposed on a track in a base skid, in accordance with certain embodiments.
Figure 6C:
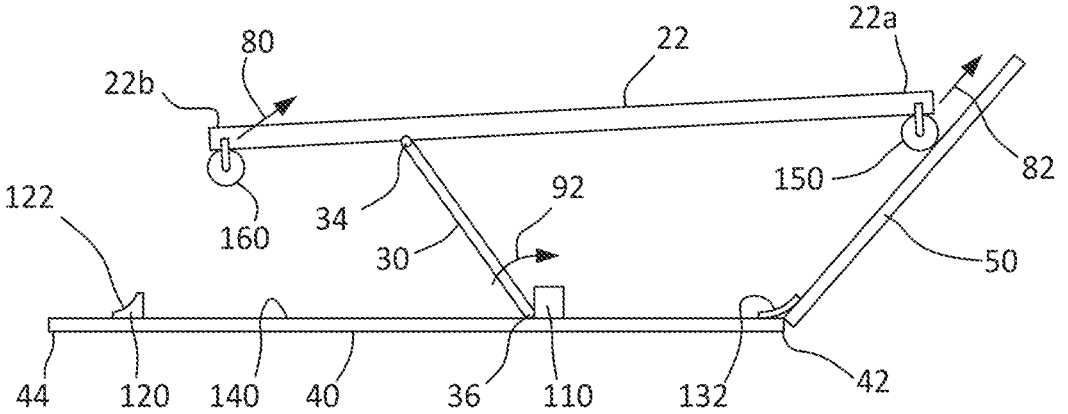
FIG. 6C is a representative simplified functional side view of a pipe handling system having a carrier in a partially deployed position with a ramp end of the carrier disposed along a track at a top an inclined ramp and a far end of the carrier lifted from the base skid by a lift arm, in accordance with certain embodiments.

FIGS. 6A-6C are simplified side views of a pipe handling system 100 to illustrate the operation of the contoured surface 122 of the far end ramp 120 as the carrier 22 moves from a stowed position in the recess 35 to at least a partially deployed position with the carrier 22 lifted out of the recess 35.

Referring to FIG. 6A, the carrier 22 is positioned in the recess 35 in the base skid 40 and is beginning to be moved along the track 140 toward the rig floor 16. The wheels 160 at the far end 22*b* can engage the track 140 and assist in reducing friction between the carrier 22 and track 140 by rolling along the track 140. As the far end 22*b* is moving toward the rig floor 16 (or ramp 50), the inertia 80 of the far end 22*b* is directed generally horizontally along the track 140 as the wheels 160 and the far end 22*b* are moving toward the far end ramps 120.

The stop 110 is located in the recess 35 (e.g., along the track 140) and can be positioned at a distance from the end 36 (e.g., rollers 170) of the lift arm 30 such that the end 36 engages the stop 110 after the wheels 160 engage the far end ramps 120. The rollers 150 at the ramp end 22*a* of the carrier 22 can already be engaged with the contoured surface 132 at an end of the tracks 140 to begin moving the ramp end 22*a* upward along the ramp 50. The inertia 82 of the ramp end 22*a* is generally directed upward in the direction of the ramp 50 but could be pointing in a direction that is more toward the ramp 50 than along the ramp 50, depending on where along the contoured surface 132 the rollers 150 have moved. The contoured surface 132 can substantially prevent (or at least minimize) an abrupt change in direction of the ramp end 22*a* of the carrier 22. The contoured surface 132 can provide a smooth transition between the track 140 of the base skid 40 and the track 56 of the ramp 50.

Referring to FIG. 6B, the wheels 160 have engaged the far end ramps 120 and have almost reached the end of the contoured surfaces 122, thereby beginning to raise the far end 22*b* from the recess 35. The inertia 80 of the far end 22*b* has transitioned (as a result of engagement with the far end ramps 120) from a direction that was generally parallel with the track 140 to an upward direction that reduces an impact of the end 36 with the stop 110, since the inertia 80 of the far end 22*b* has already been changed to an upward trajectory. The end 36 of the lift arm 30 has engaged with the stop 110 and can begin to cause the lift arm 30 to be rotated upward (arrow 92) and thereby apply an additional upward force to the carrier 22 via the end 34 being rotationally coupled to the carrier 22. The rollers 150 can move along the ramp 50, with the inertia 82 of the ramp end 22*a* generally parallel with the ramp 50.

Referring to FIG. 6C, with the end 36 of the lift arm 30 fully engaged with the stop 110, and the wheels 160 no longer in engagement with the far end ramps 120, the lift arm 30 can carry the full load of the far end 22*b* of the carrier 22 and raise it further upward from the base skid 40. However, by the far end ramps 120 providing an initial lifting force to assist in the lift arm 30 lifting the carrier 22 from the recess 35, and the change in direction of the inertia 80 of the far end 22*b*, an impact of the end 36 with the stop 110 is reduced. Normally, a carrier 22 with a lift arm 30 arrangement of a similar pipe handling system reduces damage to the pipe handling system by reducing speed of the end 36 of the lift arm 30 moving along the track 140 to the stop 110 to almost "0" zero just prior to impact of the end 36 with the stop 110, and slowly moves the end 36 into contact with the stop 110. Once contact between the end 36 and the stop 110 has occurred and their engagement is settled, the winch 29 can again begin moving the carrier toward the rig floor 16. However, this slow down causes a delay in getting the tubular 20 to the well center. The far end ramps 120 can alleviate the need for this delay by allowing the carrier to remain moving along the track 140 at normal speed, without having to slow down in anticipation of the impact of the end 36 with the stop 110.

The far end ramps 120 can provide other benefits for similar reasons, such as when a tubular 20 is being moved from the rig floor 16 to the horizontal storage area 18 via the pipe handling system 100. As the carrier 22 is being moved away from the rig floor 16, the rollers 150 can roll down the ramp 50 along the tracks 56. The lift arm 30 can rotate downward lowering the carrier 22 toward the recess 35. As the far end 22*b* is lowered, the wheels 160 can engage the contoured surfaces 122 of the far end ramps 120 and begin tracking the contour of the contoured surface 122. This will cause the inertia 80 of the far end 22*b* to change from a downward direction that is angled downward in more of a Z-axis direction that an X-axis direction to a more horizontally oriented direction that is angled downward in more of an X-axis direction that a Z-axis direction. The inertia 80 can then transition to a generally horizontal direction as the wheels 160 begin tracking along the tracks 140 in the recess 35. This helps prevent an abrupt impact of the wheels 160 to the track 140 as the carrier 22 is being lowered into the recess 35. This smoother transition allows the carrier 22 to continue being lowered at a normal speed without having to reduce speed to prevent an abrupt damaging impact of the wheels 160 with the track 140.

Figure 6D:
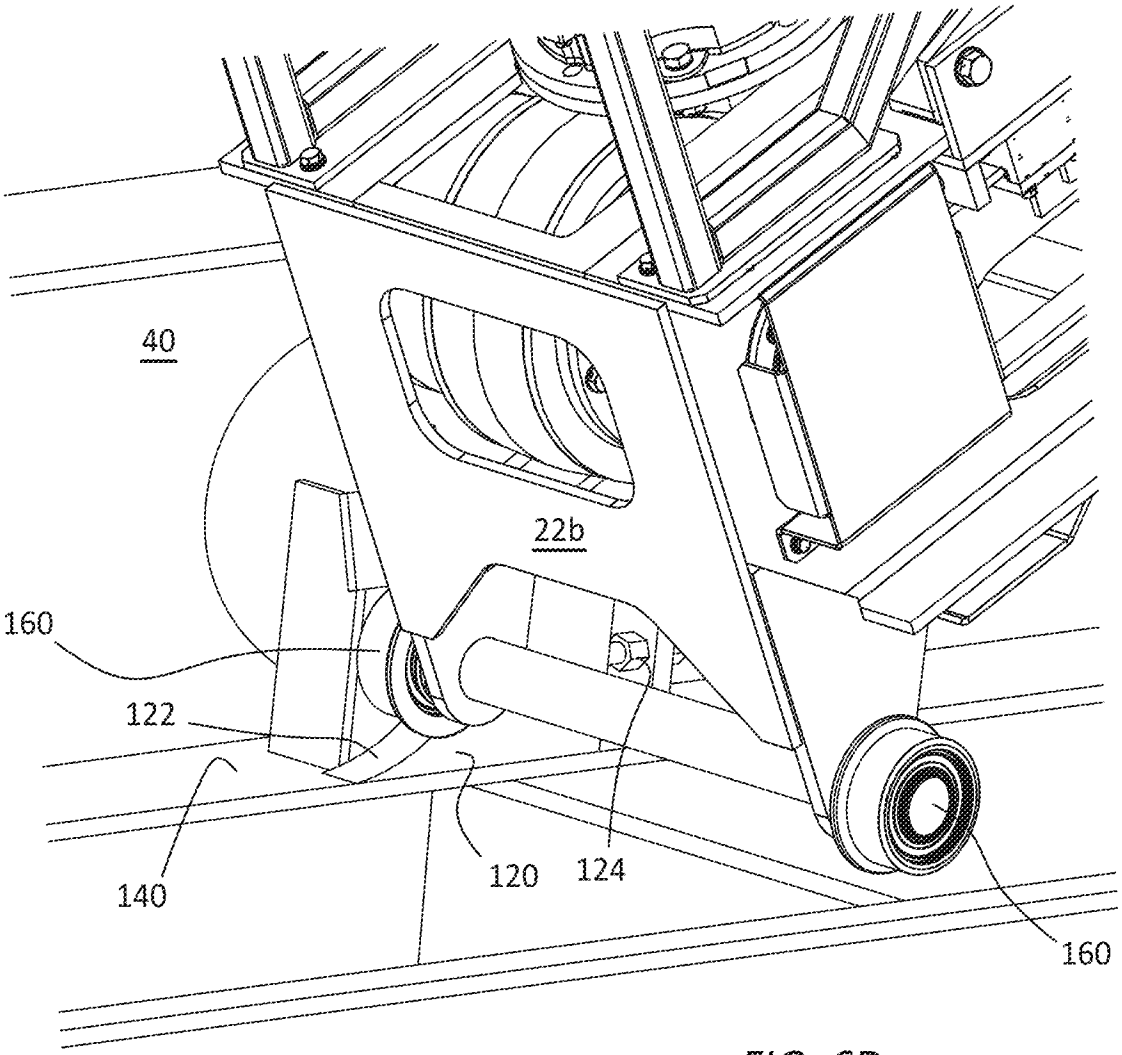
FIG. 6D is a representative perspective view of a far end of a carrier of a pipe handling system engaging a far end ramp as the far end is being lifted from a base skid, in accordance with certain embodiments.

FIG. 6D is a representative perspective view of the far end 22*b* of a carrier 22 of a pipe handling system 100 that is engaging a far end ramp 120 as the far end 22*b* is being lifted from (or lowered to) a base skid, in accordance with certain embodiments. Each of the wheels 160 can be engaged with a contoured surface 122 of a far end ramp 120 that can be used to change a direction of inertia 80 of the far end 22*b*. A position of the far end ramp 120 can be adjusted by the adjuster 124, which can move the far end ramp 120 horizontally along the track 140. This can be used to adjust a horizontal position of the far end ramp 120 (and thereby the contoured surface 122) relative to the track 140.

The contoured surface 122 can be any shape that causes the wheel 160 of the far end 22*b* to diverge from horizontal movement along the track 140 when the wheel 160 engages the contoured surface 122. As used herein, "diverge" refers to moving at least partially in a vertical direction away from the horizontal track 140. In non-limiting embodiments, FIGS. 6E-6H show various examples of a contoured surface 122 that can be utilized by the pipe handling system 100. Each contoured surface 122 can include one or more segments 122*a*, 122*b*, or 122*c*, and each segment can define a distinctive portion of the contoured surface 122, such as a curved surface having a different radius, a linear surface at different angles, etc. There can be more than or fewer than the segments 122*a*, 122*b*, or 122*c*, as illustrated by FIGS. 6E-6H.

Figure 6F:
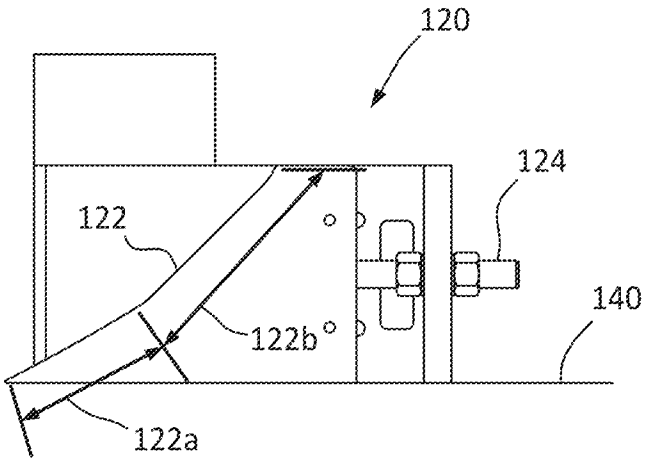
FIGS. 6E-6H are representative side views of a far end ramp with variously shaped contoured surfaces, in accordance with certain embodiments.
Figure 6H:
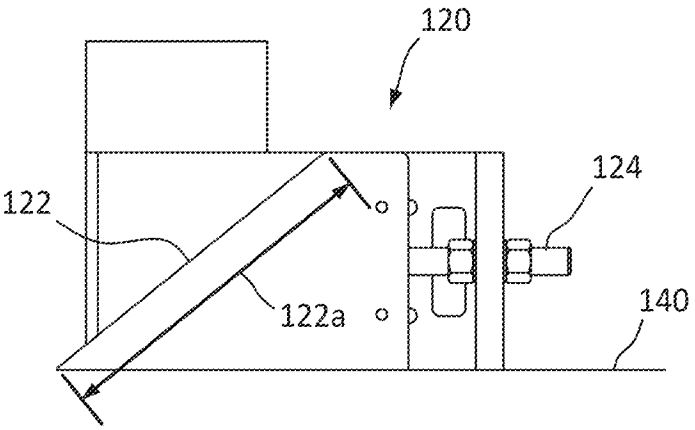
Figure 6E:
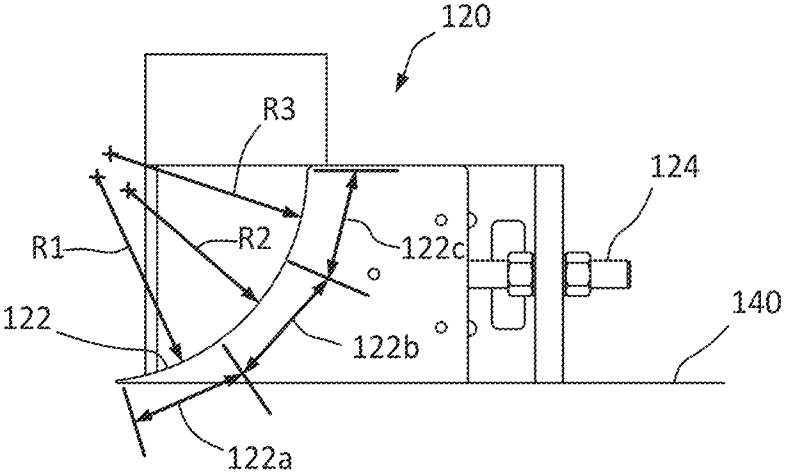

FIG. 6E shows a side view of the far end ramp 120 which can be positioned along the track 140 of the base skid 40. The contoured surface 122 can include three segments 122*a-c*, where a first segment 122*a* may have a curved shape that has a first radius R1, a second segment 122*b* may have a curved shape that has a second radius R2, and a third segment 122*c* may have a curved shape that has a third radius R3. In this example, the first radius R1 can be larger than the second radius R2, which can be a slower rate of divergence of the far end 22*b* from the track 140 compared to the second radius R2. The second radius R2 can increase a rate of divergence by being a smaller radius, and the third radius can be a larger radius, similar to the first radius. However, it should be understood that the first, second, and third radii can be all different radii, forming a varied contour of the contoured surface 122.

The first, second, and third radii R1, R2, R3 can all be equal forming a single circular contoured surface. The wheel 160 can engage the contoured surface 122 as the wheel 160 is traveling along the track 140. The wheel 160 will begin to diverge from the track 140 as the wheel travels further toward the ramp 50 and travels further along the contoured surface 122 until the wheel 160 is lifted out of engagement with the contoured surface 122 by the lift arm 30 that rotates to raise the far end 22*b*.

FIG. 6F is another example of a contoured surface 122 which can be used to diverge the far end 22*b* from the track 140. In this example, the contoured surface 122 can include two segments 122*a*, 122*b*, where the first segment 122*a* is generally linearly shaped and disposed at an angle from the track 140. The second segment 122*b* generally linearly shaped and disposed at a greater angle than the first segment 122*a*. The contoured surface 122 can include a rounded surface between the first segment 122*a* and the second segment 122*b*, for smooth transition, but the curved portion is not required. This contoured surface 122 will also act to diverge the far end 22*b* from that track 140 as the far end 22*b* travels along the track 140 and engages the contoured surface 122.

Figure 6G:
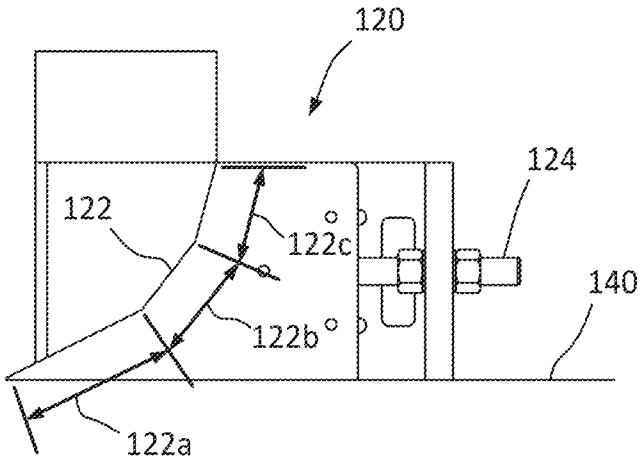

FIG. 6G is another example of a contoured surface 122 which can be used to diverge the far end 22*b* from the track 140. In this example, the contoured surface 122 can include three segments 122*a*, 122*b*, 122*c* where each of the segments are generally linearly shaped and disposed at a progressively larger angle from the track 140. In this configuration, the contoured surface 122 does not have curved transitions between the adjacent segments 122*a*, 122*b*, 122*c*. This contoured surface 122 will also act to diverge the far end 22*b* from that track 140 as the far end 22*b* travels along the track 140 and engages the contoured surface 122.

FIG. 6H is another example of a contoured surface 122 which can be used to diverge the far end 22*b* from the track 140. In this example, the contoured surface 122 can includes only one segment 122*a* which is generally linearly shaped and disposed at a desired angle from the track 140. This contoured surface 122 will also act to diverge the far end 22*b* from that track 140 as the far end 22*b* travels along the track 140 and engages the contoured surface 122.

It should be understood that a mirrored version of the far end ramp 120 can be installed on an opposite side of the track 140 from the far end ramp 120 and positioned at the same horizontal position as the far end ramp 120. Wheels 160 positioned on each side of the far end 22*b* can simultaneously engage their respective far end ramp 120 or mirrored far end ramp 120 to diverge the far end 22*b* from the track 140. The adjuster 124 can be used to adjust the horizontal positions of each of the far end ramp 120 and the mirrored far end ramp 120 to calibrate them to the desired position relative to the stop 110. The wheels 160 can disengage from the contoured surface 122 at any point along the contoured surface 122. This can depend upon with the lift arm 30 lifts the far end 22*b* from the contoured surface 122.

It should also be understood that the contoured surface 132 can have similar contours as described herein for the contoured surface 122.

Figure 7:
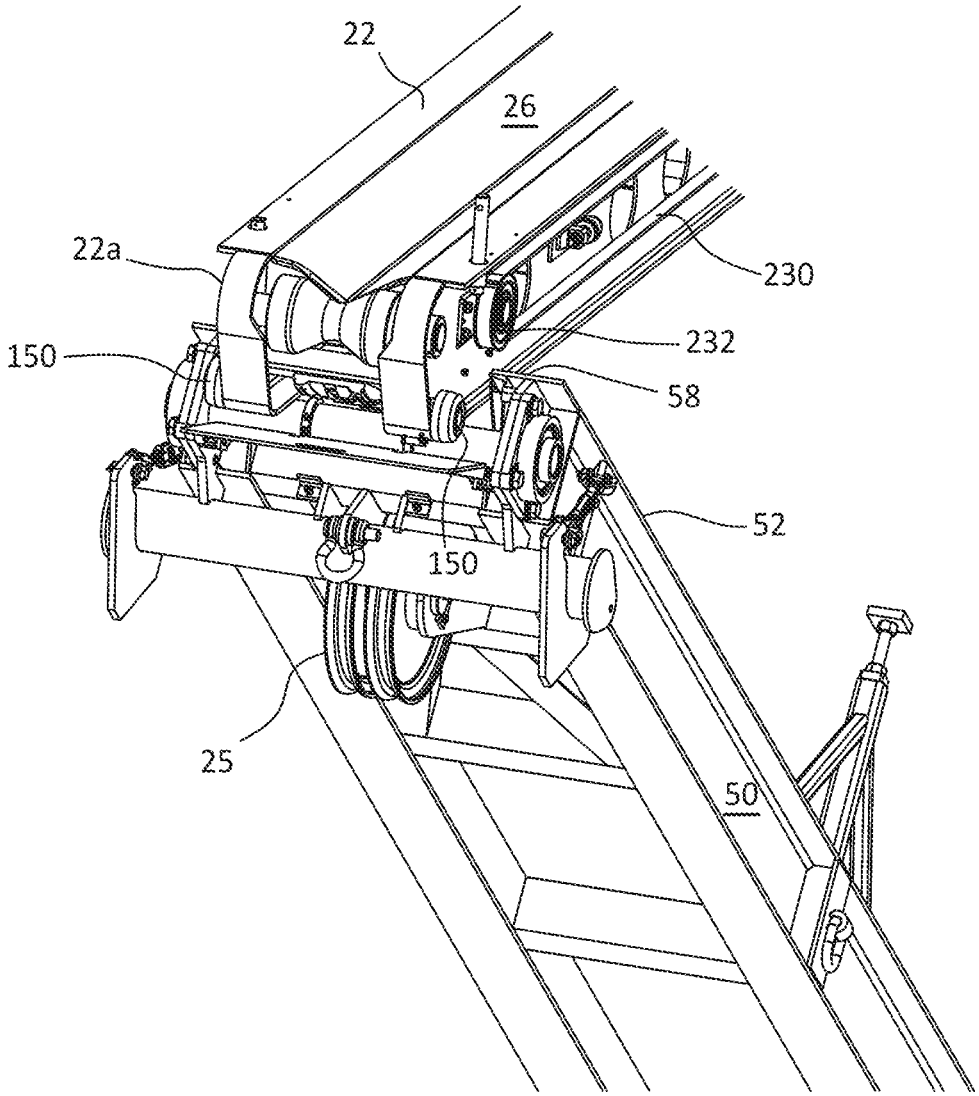
FIG. 7 is a representative perspective view of a ramp end of a carrier positioned at an upper end of a ramp, in accordance with certain embodiments.

FIG. 7 is a representative perspective view of a ramp end 22*a* of a carrier 22 positioned at an upper end 52 of a ramp 50, in accordance with certain embodiments. The carrier 22 is shown in a similarly deployed position as shown in FIG. 5C, where the ramp end 22*a* is at the upper end 52 of the ramp 50 and the ramp end 22*a* has extended past the upper end 52. The rollers 150 have moved out of the tracks 56 of the ramp 50 and have extended past the upper end 52. One feature of the upper end 52 is that a flange 58 can be extended longitudinally relative to the ramp 50 on both sides of the ramp 50, such that when the carrier 22 is being lowered back to the base skid 40, the rollers 150 engage the flanges 58 to restrain the ramp end 22*a* to the ramp 50 and ensure that the rollers 150 enter the ramp 50 and engage the tracks 56 properly for lowering the ramp end 22*a* down the ramp 50.

A continuous drive belt 230 can be used to drive a skate 200 along the carrier 22. The continuous drive belt 230 can engage an idler pulley 232 at the ramp end 22*a*. The continuous drive belt 230 can extend from the far end 22*b* to the ramp end 22*a* and be used to slide the skate forward and backward along the longitudinal V-groove 26 of the carrier 22.

Figure 8:
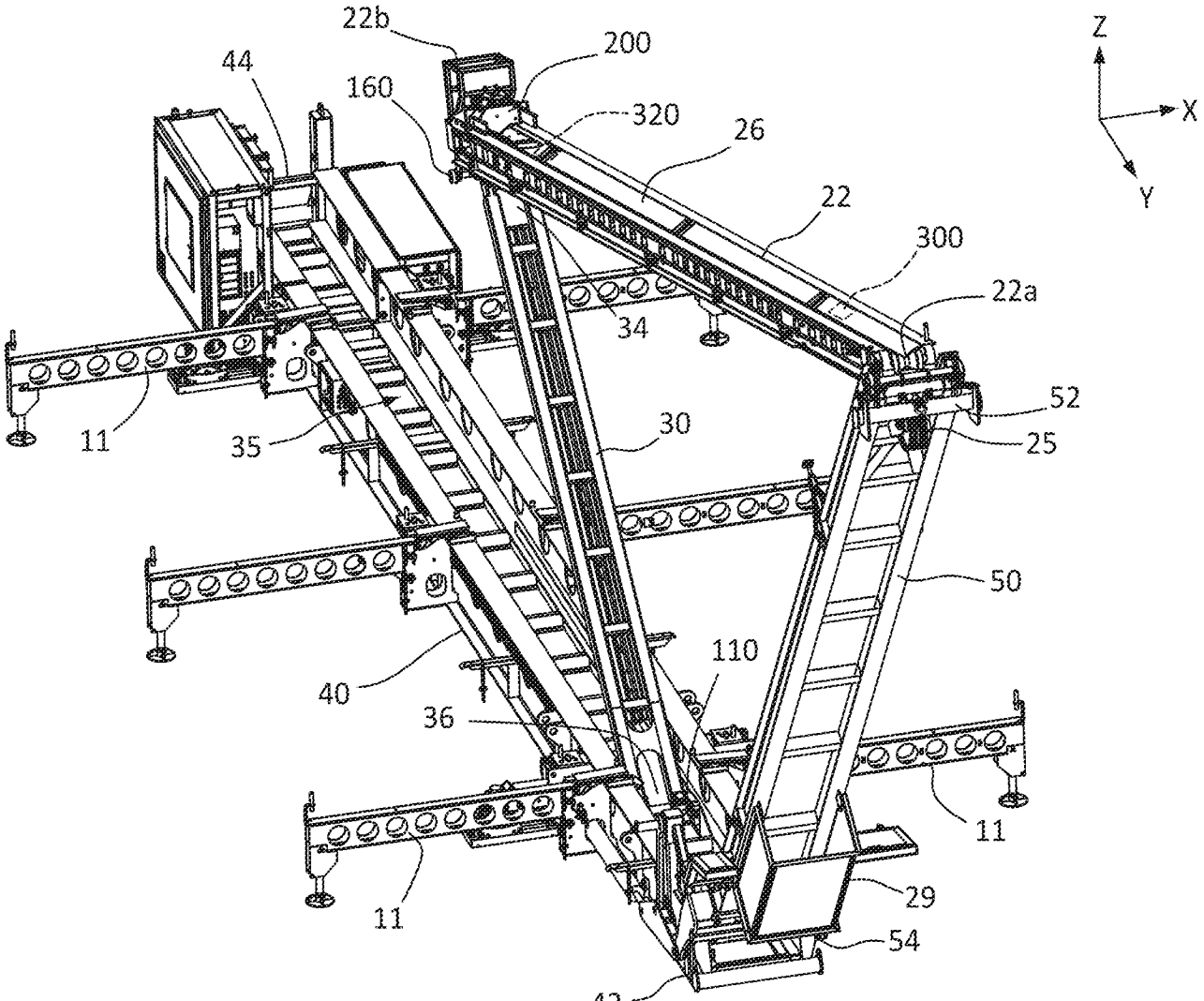
FIG. 8 is a representative perspective view of a pipe handling system having a carrier in a partially deployed position with a ramp end of the carrier disposed along a track at an upper end of a ramp and a far end of the carrier lifted from the base skid by a lift arm, in accordance with certain embodiments.

FIG. 8 is a representative perspective view of a pipe handling system 100 having a carrier 22 in a partially deployed position with a ramp end 22*a* of the carrier 22 disposed along a track 56 at an upper end 52 of a ramp 50 and a far end 22*b* of the carrier 22 can be lifted from the base skid 40 by a lift arm 30, in accordance with certain embodiments. This partially deployed position is similar to the partially deployed position of the pipe handling system 100 shown in FIG. 5C. In a non-limiting embodiment, the carrier 22 can include one or more ranging sensors 300, 320.

A ranging sensor 300 can be positioned proximate the ramp end 22*a* of the carrier 22 to detect parameters of the tubular 20 held in the longitudinal V-groove 26 of the carrier 22. In particular, the ranging sensor 300 can be used to detect parameters of an end (e.g., box end 62) of the tubular 20 closest to the ramp end 22*a* of the carrier 22.

Additionally, or alternatively, a ranging sensor 320 can be positioned proximate the far end 22*b* of the carrier 22 to detect parameters of the tubular 20 held in the longitudinal V-groove 26. In particular, the ranging sensor 320 can be used to detect parameters of an opposite end (e.g., pin end 60) of the tubular 20 closest to the far end 22*b* of the carrier 22. Therefore, when a tubular 20 is moved into the longitudinal V-groove 26, such as when the carrier 22 is stowed in the base skid, the skate 200 along with the ranging sensor(s) 300, 320 can be used to determine various parameters of the tubular 20. Each of the ranging sensor(s) 300, 320 can be a light detection and ranging (LiDAR) sensor, a time-of-flight sensor, an optical ranging sensor, a laser ranging sensor, or a combination thereof.

In a non-limiting embodiment, the skate 200 can engage a pin end 60 of the tubular 20, verify a presence of the tubular 20 in the carrier 22, or measure parameters of the tubular 20 such as lengths of the tool joints, pin threads, overall length of the tubular 20.

Figure 9:
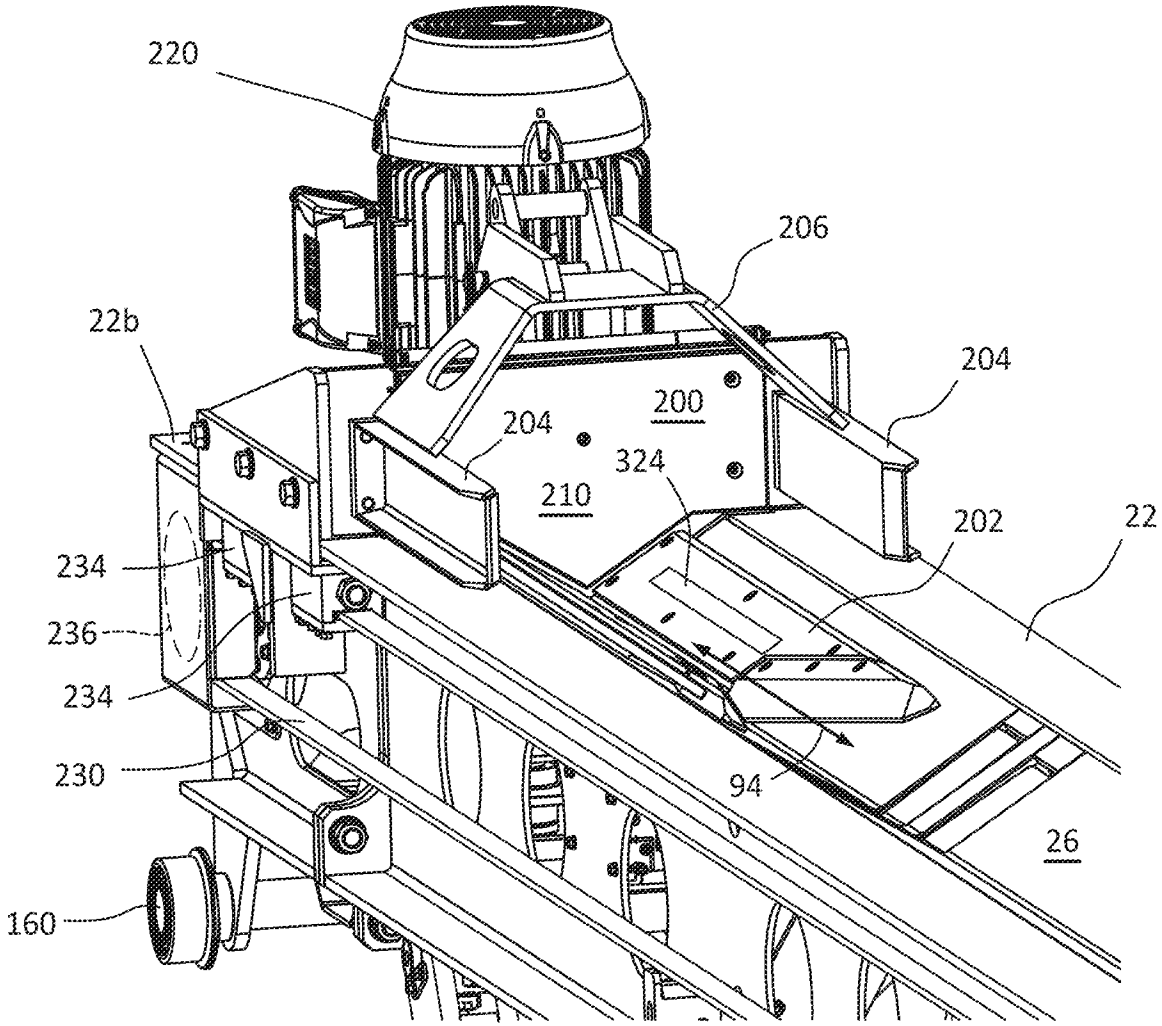
FIG. 9 is a representative perspective view of a far end of a carrier of a pipe handling system, in accordance with certain embodiments.

FIG. 9 is a representative perspective view of the far end 22*b* of the carrier 22 of the pipe handling system 100, in accordance with certain embodiments. The carrier 22 can include a skate 200 that is slidably coupled to the carrier 22 such that it can be used to slide tubulars 20 along the longitudinal V-groove 26. A motor 220 can be used to drive the continuous drive belt 230 (such as via drive gear 236), thereby moving the skate 200 along the longitudinal V-groove 26 due to the clamps 234 that can fixedly attach the skate 200 to the continuous drive belt 230. As the drive gear 236 rotates in a first direction, the skate 200 can be moved along the longitudinal V-groove 26 in a longitudinal direction. When the drive gear 236 rotates in an opposite second direction, the skate 200 can be moved along the longitudinal V-groove 26 in an opposite longitudinal direction.

The skate 200 can have guards 204 positioned on either side of the carrier 22 and a retainer shroud 206 positioned above the guards 204 and straddling between the guards 204 to ensure the tubular 20 remains within the skate 200. A V-groove skate extension 202 can extend from the skate below a pipe sensor 210 and above the longitudinal V-groove 26 of the carrier 22. The V-groove skate extension 202 is configured to slide under a cylindrical end (e.g., pin end 60) of the tubular 20 when the skate 200 moves (arrows 94) along the longitudinal V-groove 26 to engage the tubular 20 that has been moved into the longitudinal V-groove 26.

A slotted opening 324 can be aligned with an opening in a surface of the longitudinal V-groove 26 to make measurements of parameters of the tubular 20. These measurements are described in more detail below. As the skate 200 moves along the longitudinal V-groove 26 to engage the tubular 20, the end of the tubular 20 (e.g., pin end 60) can engage the pipe sensor 210, which can be actuated by the engagement of the tubular 20 to indicate a presence of the tubular 20 and that the end of the tubular 20 is properly positioned in the skate 200.

Figure 10:
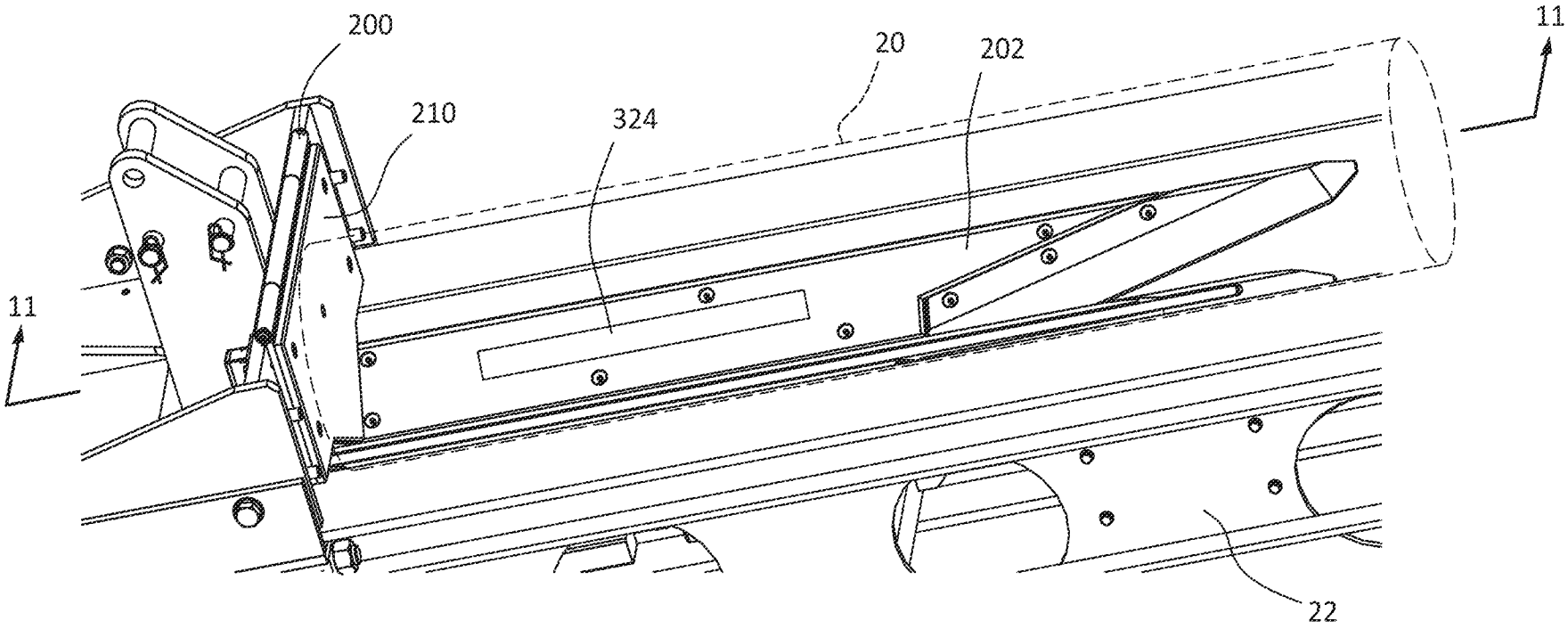
FIG. 10 is a representative simplified perspective side view of a skate on a far end of a carrier, in accordance with certain embodiments.

FIG. 10 is a representative simplified perspective side view of a skate 200 on a far end 22*b* of a carrier 22, in accordance with certain embodiments. The skate 200 is shown without the guards 204 and shroud 206 for discussion purposes. The skate 200 has been moved along the longitudinal V-groove 26 such that the V-groove skate extension 202 causes the end of the tubular 20 (shown as an outline) to be lifted from the longitudinal V-groove 26 and slide over the V-groove skate extension 202 until the pin end 60 engages the pipe sensor 210.

Figure 11:
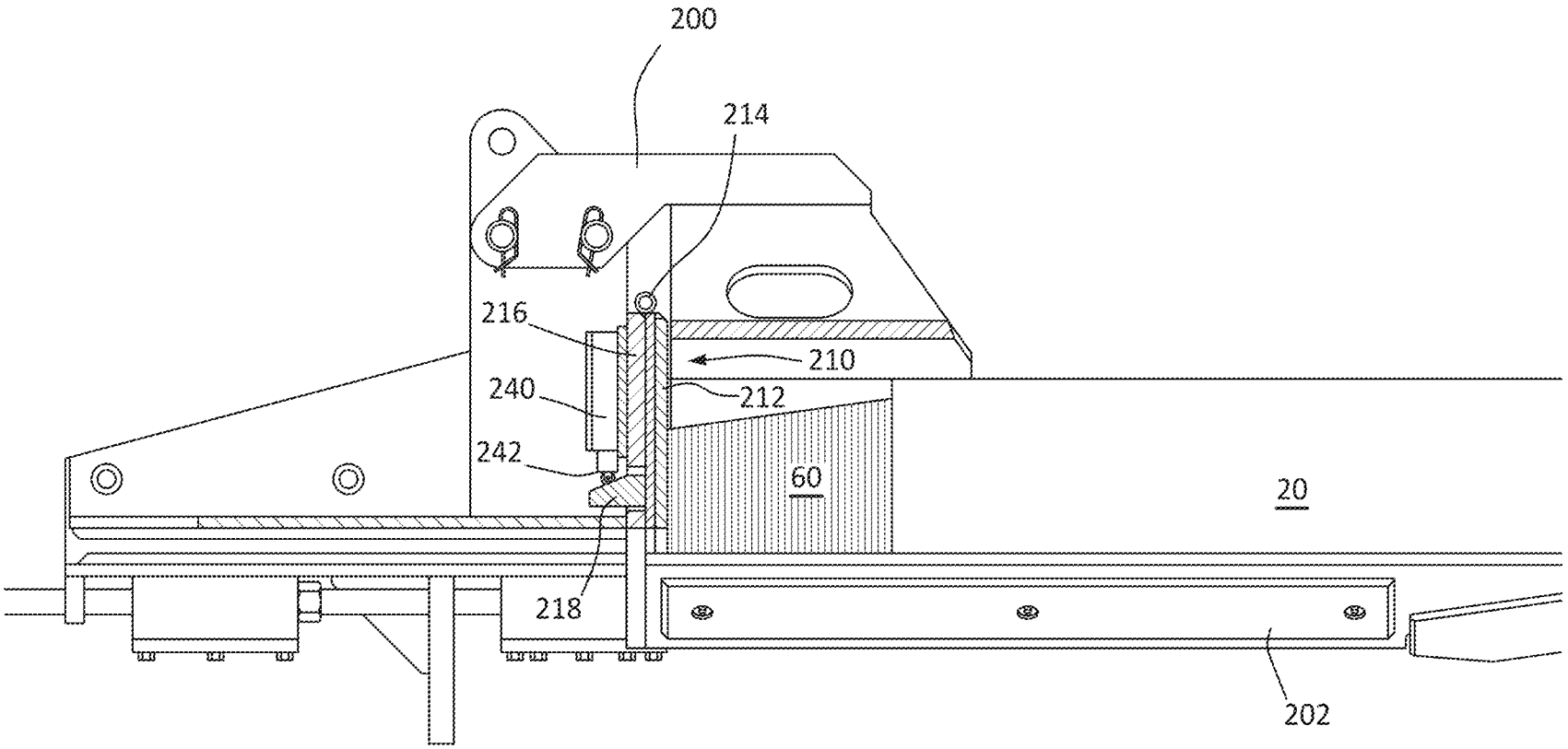
FIG. 11 is a representative partial cross-sectional side view along line 11-11, as indicated in FIG. 10, of a skate of a pipe handling system, in accordance with certain embodiments.

FIG. 11 is a representative partial cross-sectional side view along line 11-11, as indicated in FIG. 10, of the skate 200 of the pipe handling system 100, in accordance with certain embodiments. The pin end 60 of the tubular 20 has been engaged by the pipe sensor 210. The engagement plate 212 can rotate about hinge 214 toward support structure 216 when the pin end 60 engages the pipe sensor 210. This rotation pushes the protrusion 218 back, thereby operating the switch actuator 242 and switching the switch 240.

Figure 12:
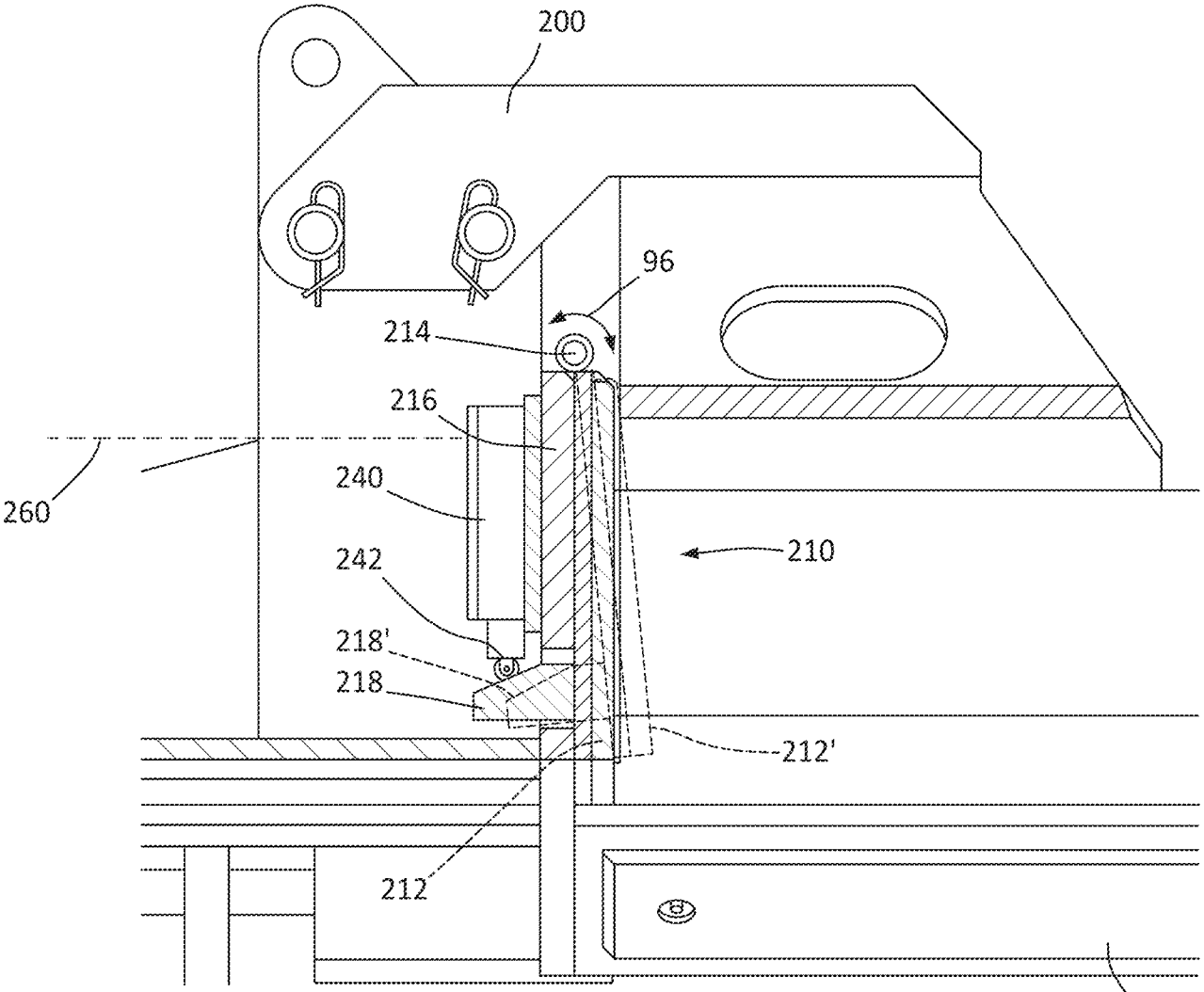
FIG. 12 is a representative detailed partial cross-sectional side view along line 11-11, as indicated in FIG. 10, of a skate of a pipe handling system, the skate having a pipe sensor, in accordance with certain embodiments.

FIG. 12 is a representative detailed partial cross-sectional side view along line 11-11, as indicated in FIG. 10, of a skate 200 of a pipe handling system 100, the skate 200 having a pipe sensor 210, in accordance with certain embodiments. When the pipe sensor 210 is not engaged with a tubular 20, the engagement plate is biased into the rotated position 212' with the protrusion 218 in the rotated position 218'. In the rotated position 218', the protrusion 218 allows the switch actuator 242 to extend from the switch 240. However, when the tubular 20 correctly engages the pipe sensor 210, then the engagement plate 212 moves from the rotated position 212' to the non-rotated (or engaged) position shown as engagement plate 212).

Moving the engagement plate 212 to the engaged position, the protrusion 218 is also moved (arrows 96) from the rotated position 218' to the engaged position shown as protrusion 218. This causes the switch actuator to be pushed into the switch 240, thereby actuating the switch 240 to indicate the presence of the tubular 20 in the skate 200. The switch 240 can also be sensitive to the distance the switch actuator 242 is pushed into the switch 240 thereby detecting if the tubular 20 is only partially engaging the engagement plate 212 and that an undesired gap may remain between the engagement plate 212 and the support structure 216. The switch 240 can wirelessly communicate (e.g., network 260) a signal to the rig controller 250 that indicates a presence or absence of the tubular 20 in the skate 200. The switch 240 can be powered by an energy storage device (e.g., battery, capacitor, etc.).

Figure 13:
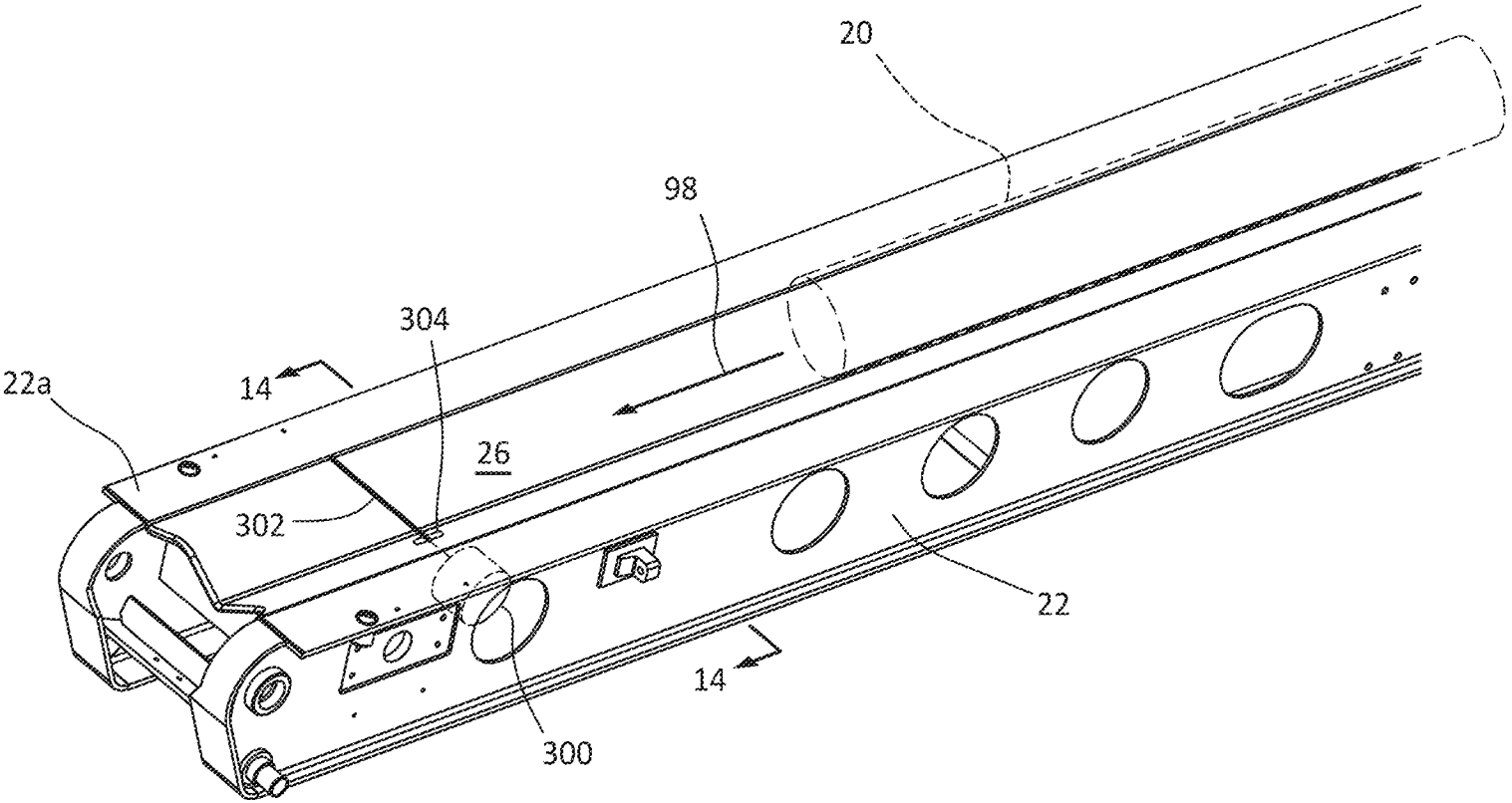
FIG. 13 is a representative perspective view of a ramp end of a carrier of a pipe handling system, the carrier having a ranging sensor, in accordance with certain embodiments.

FIG. 13 is a representative perspective view of a ramp end 22*a* of a carrier 22 of a pipe handling system 100, the carrier 22 having a ranging sensor 300, in accordance with certain embodiments. The ranging sensor 300 can be positioned proximate the ramp end 22*a* of the carrier 22. The ranging sensor 300 can project a signal 302 (such as an optical signal) that can measure distance from the sensor 300 by the sensor 300 being able to detect when the signal 302 is interrupted and how far away from the sensor is the object or surface that interrupted the signal 302. An opening 304 can be formed in the longitudinal V-groove 26 at a position that aligns with the signal 302. When a tubular 20 is moved along the longitudinal V-groove 26 (arrows 98), such as by the skate 200, the sensor 300 can detect when the front edge of the tubular 20 first intersects the signal 302. Since the relative position of the signal 302 to the skate 200 (or more particularly, the pipe sensor 210) is known, when the front edge of the tubular 20 first intersects the signal 302, the overall length of the tubular 20 from the signal 302 to the pipe sensor 210 can be determined. The operation of the skate 200 and the ranging sensor(s) 300, 320 is described in more detail below.

Figure 14A:
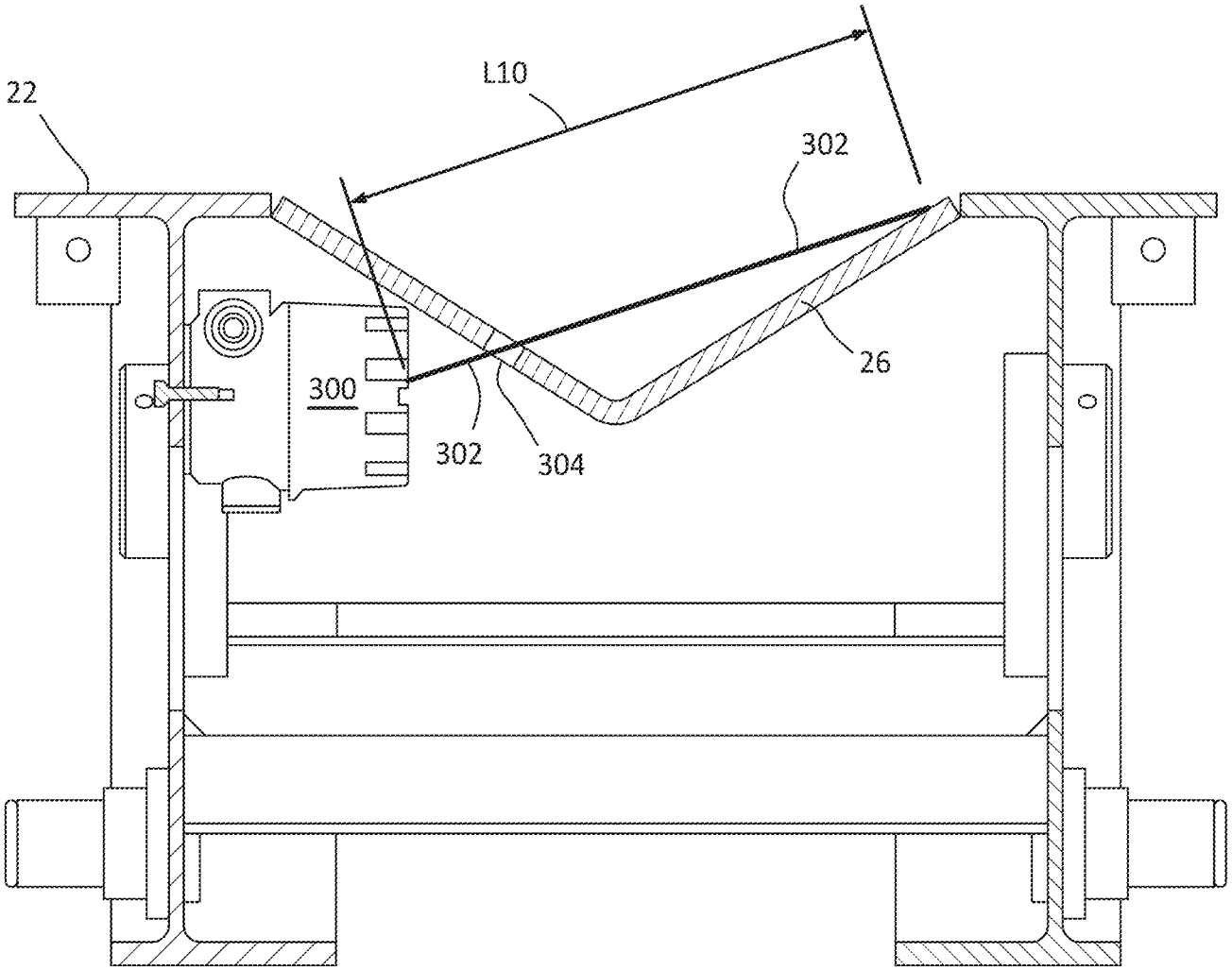
FIG. 14A is a representative partial cross-sectional end view along line 14-14, as indicated in FIG. 13, of a ranging sensor mounted to a carrier of a pipe handling system before a tubular interrupts a signal of the ranging sensor, in accordance with certain embodiments.

FIG. 14A is a representative partial cross-sectional end view along line 14-14, as indicated in FIG. 13, of a ranging sensor 300 mounted to a carrier 22 of a pipe handling system 100 before a tubular 20 interrupts a signal 302 of the ranging sensor 300, in accordance with certain embodiments. The ranging sensor 300 can direct a signal 302 through the opening 304 to impinge on a surface that is on an opposite side of the longitudinal V-groove 26 from the sensor 300 and the opening 304. The position of the opening 304, angle of the signal 302, and position of the ranging sensor 300 can be altered as desired to detect when an object interrupts the signal 302. The configuration shown in FIGS. 14A-14B is a non-limiting embodiment, and other configurations are available, such as mounting the sensor 300 on the opposite side and transmitting the signal 302 to the left (opposite to the configuration shown in FIGS. 14A-14B).

Before the tubular 20 interrupts the signal 302, the distance of the signal 302 can be seen as the length L10 from the sensor 300 to the impingement point on the surface of the longitudinal V-groove 26. Since the length L10 is measuring the full distance from the sensor 300 to the impingement point on the surface of the longitudinal V-groove 26, it can indicate that no object is present at the position of the sensor 300 on the carrier 22. It should be understood that the signal does not need to be directed to an impingement point on the carrier 22. It can simply be aimed out into the space around the carrier 22. However, it may be preferred to have it impinge on a surface for safety reasons, if the signal is a laser signal.

Figure 14B:
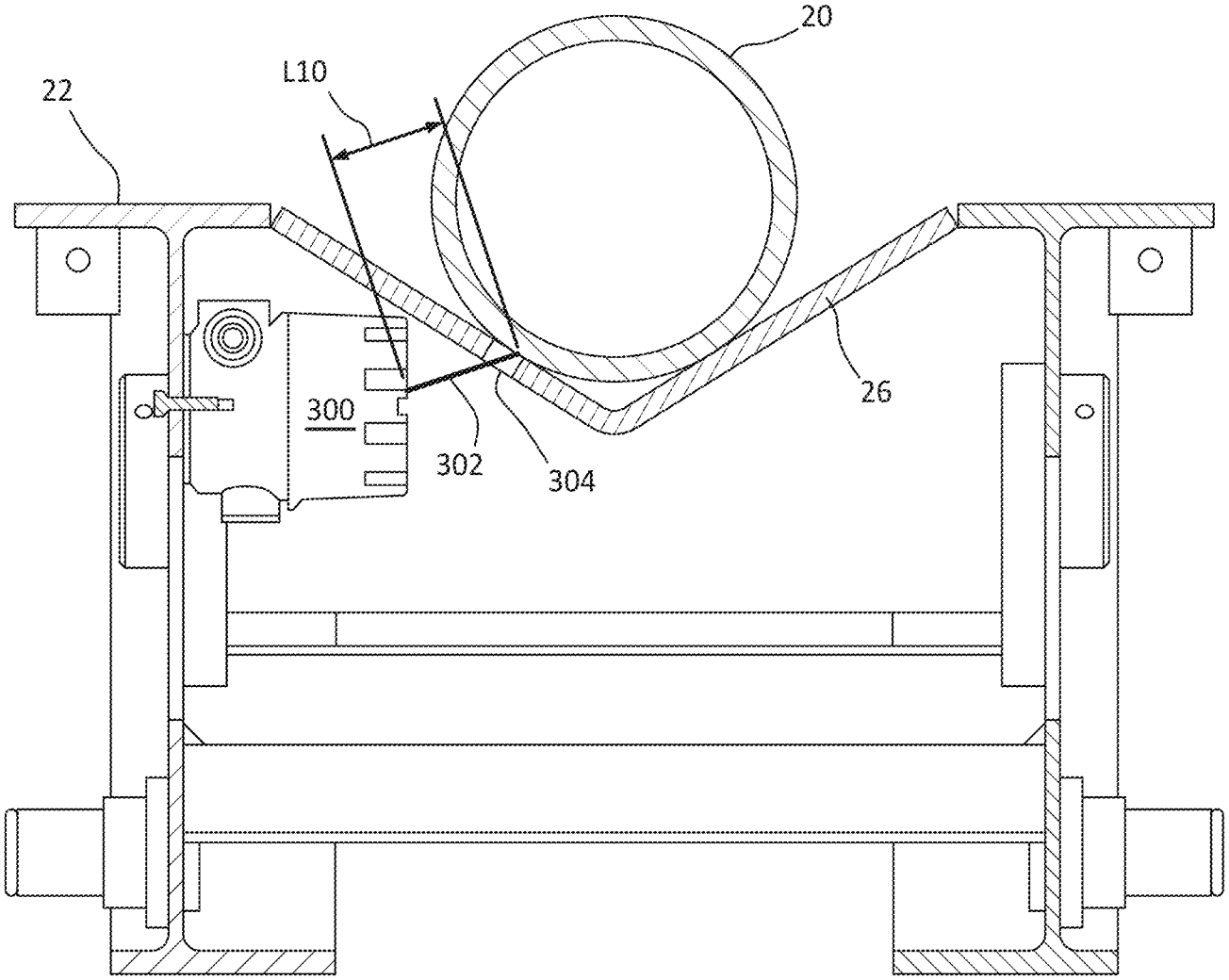
FIG. 14B is a representative partial cross-sectional end view along line 14-14, as indicated in FIG. 13, of a ranging sensor mounted to a carrier of a pipe handling system after a tubular has interrupted a signal of the ranging sensor, in accordance with certain embodiments.

FIG. 14B is a representative partial cross-sectional end view along line 14-14, as indicated in FIG. 13, of a ranging sensor 300 mounted to a carrier 22 of a pipe handling system 100 after the tubular 20 has interrupted the signal 302 of the ranging sensor 300, in accordance with certain embodiments. At the moment when the edge of the tubular 20 first interrupts the signal 302, the overall length of the tubular 20 can be determined, due to the known relative position of the skate 200 to the sensor 300.

When the tubular 20 interrupts the signal 302, the length L10 is determined by the sensor to be smaller than the value when no object was present at the sensor 300. Therefore, the sensor 300 can determine, due to the shortened length L10, that an object (or at least a portion of the object) is in the longitudinal V-groove 26 at the sensor 300, and knowing when the object first interrupts the signal 302, the rig controller 250 can determine, based on the relative position of the skate 200 at the time of the interruption, the overall length L1 of the tubular 20 (see FIG. 15A). As the tubular 20 continues to move along the longitudinal V-groove 26 toward well center, the length L10 may vary as the varied outer diameters of the end of the tubular 20 are detected by the sensor 300.

FIGS. 15A-15G are representative simplified functional side views of a tubular 20 progressing along a carrier 22 of a pipe handling system 100 as ranging sensors 300, 320 detect aspects of the tubular 20, in accordance with certain embodiments. The tubular 20 can be arranged as shown in FIGS. 15A-15G with a pin end 60 proximate the skate 200 (e.g., far end 22*b*) and a box end 62 positioned at an opposite end of the carrier (e.g., ramp end 22*a*) with a body portion 64 of the tubular 20 extending between the pin end 60 and the box end 62. However, other orientations of the tubular 20 can be accommodated in keeping with the principles of this disclosure.

Each of the tubulars 20 in these figures indicate an overall length L1, a length L2 of the pin end 60, a length L3 of the body portion 64, a length L4 of the tool joint of the box end 62, a length L5 of the threads of the pin end 60, and a length L6 of the tool joint of the pin end 60. The sequences illustrated by FIGS. 15A-15G and described in reference to these FIGS. 15A-15G can explain how these lengths L1-L6 can be determined using the skate 200, and the ranging sensors 300, 320 and respective signals 302, 322. The process illustrated in FIGS. 15A-15G is merely an example of a way the tubular aspects (or characteristics) can be determined. However, this is to be seen as a non-limiting embodiment and described here to illustrate at least one way to determine the aspects.

Figure 15A:
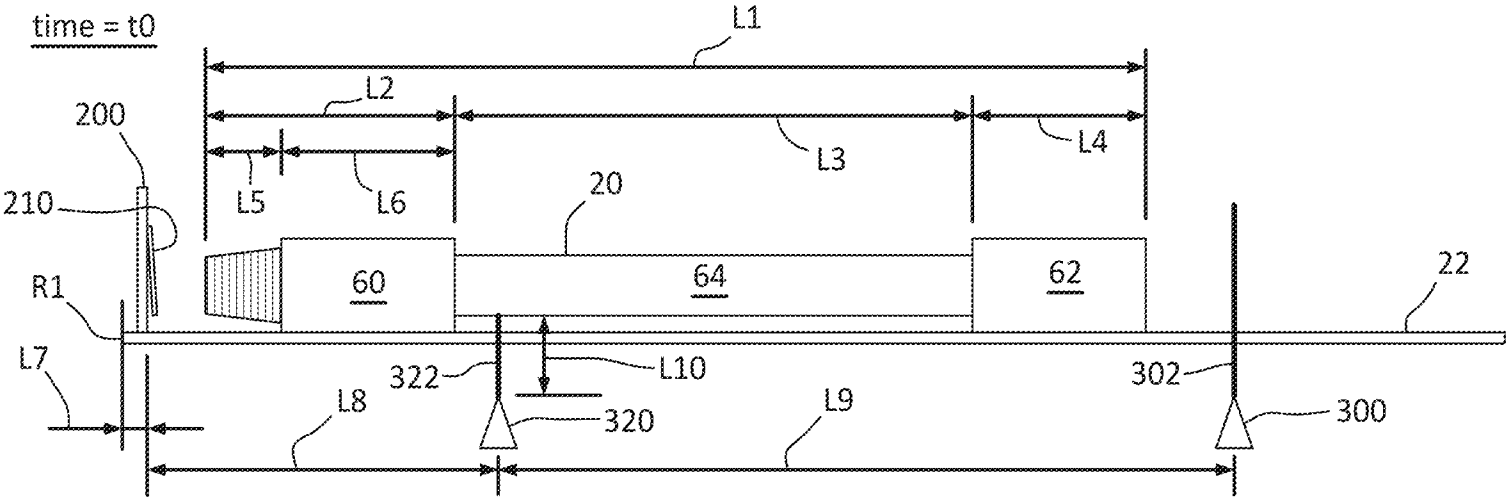
FIGS. 15A-15G are representative simplified functional side views of a tubular progressing along a carrier of a pipe handling system as ranging sensors detect aspects of the tubular, in accordance with certain embodiments.

Referring to FIG. 15A, at time t0, a tubular 20 has been moved onto the carrier 22 of the pipe handling system 100. The skate 200 can be set at a distance L7 from a reference point R1 (such as at the end of the carrier 22) which remains constant relative to the carrier 22. The reference point R1 can be at other locations on the carrier 22, as long as its position is substantially constant relative to the carrier 22. The skate 200 has not yet been advanced to engage the pin end 60. The pipe sensor 210 is in its rotated position which indicates a tubular 20 is not present in the skate 200.

The signal 322 of the ranging sensor 320 is interrupted by the body 64 and measures a distance L10 from the ranging sensor 320 to the outer surface of the body 64. The ranging sensor 320 can be positioned at a distance L8 along the longitudinal V-groove 26 of the carrier 22. The distance L8 will vary as the skate 200 is moved, but the position of the ranging sensor 320 relative to the reference point R1 remains substantially constant (i.e., L7+L8). The ranging sensor 300 can be positioned at a distance L9 from the ranging sensor 320 along the longitudinal V-groove 26. The ranging sensor 300 transmits a signal 302 which is not yet interrupted by an object. However, if the ranging sensor 300 is directed to an opposite surface of the longitudinal V-groove 26 (as in FIGS. 14A-14B), then the distance measured by the ranging sensor 300 to the opposite surface of the longitudinal V-groove 26 can be determined.

Figure 15B:
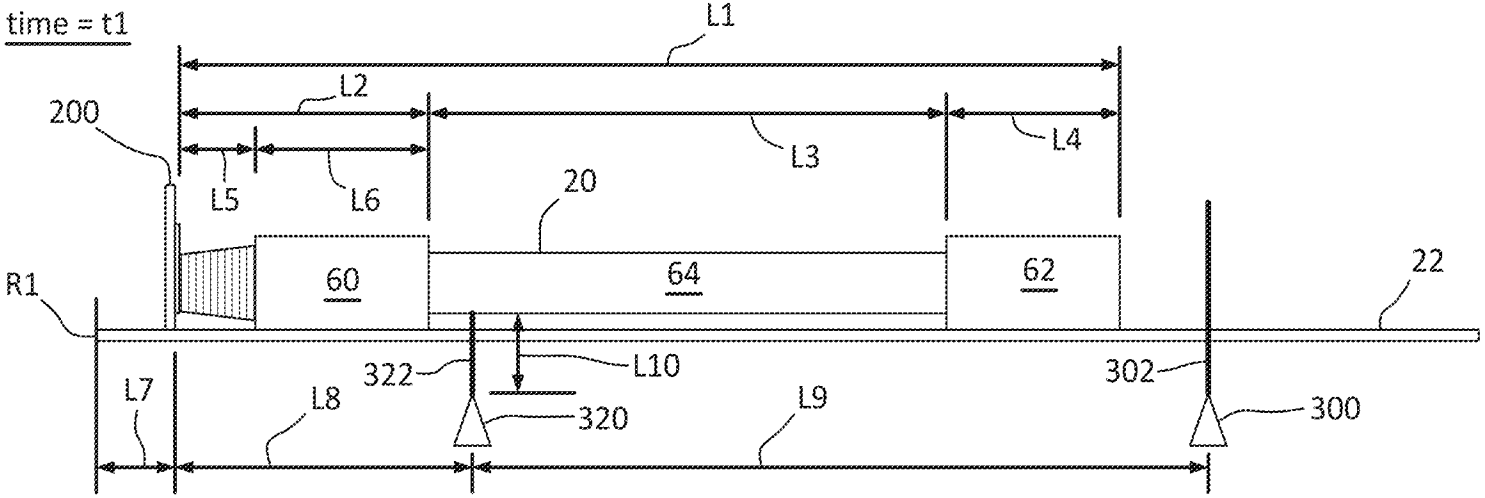

Referring to FIG. 15B, at time t1, the skate 200 has been moved along the longitudinal V-groove 26 to engage the pin end 60 with the pipe sensor 210, which can be rotated to the non-rotated or actuated position indicating that a tubular 20 is present in the skate 200 and properly positioned in the skate 200. The tubular 20 has not yet been moved, so the ranging sensor 320 can still be measuring the distance L10 to the outer surface of the body 64.

Figure 15C:
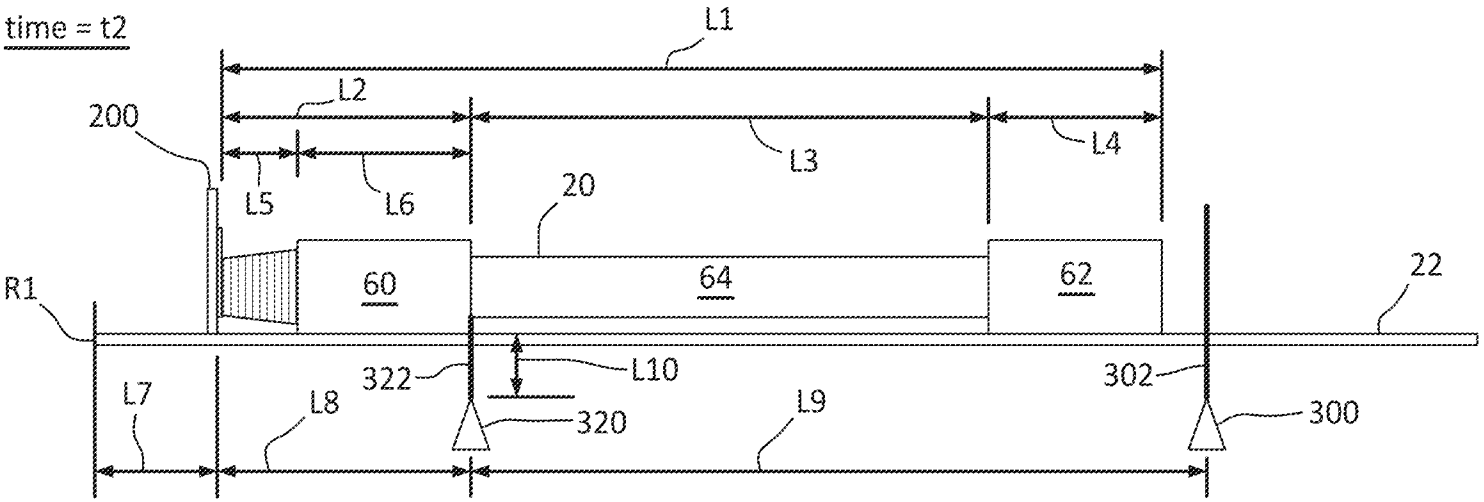

Referring to FIG. 15C, at time t2, the skate 200 has moved the tubular 20 until the leading edge of the tool joint of the pin end 60 is interrupting the signal 322, thereby reducing (or beginning to reduce) the distance L10, which can be measured by the ranging sensor 320. With the leading edge of the pin end 60 detected, the rig controller 250 can determine the overall distance L2 of the pin end 60, which should equal distance L8 at time t2.

Figure 15D:
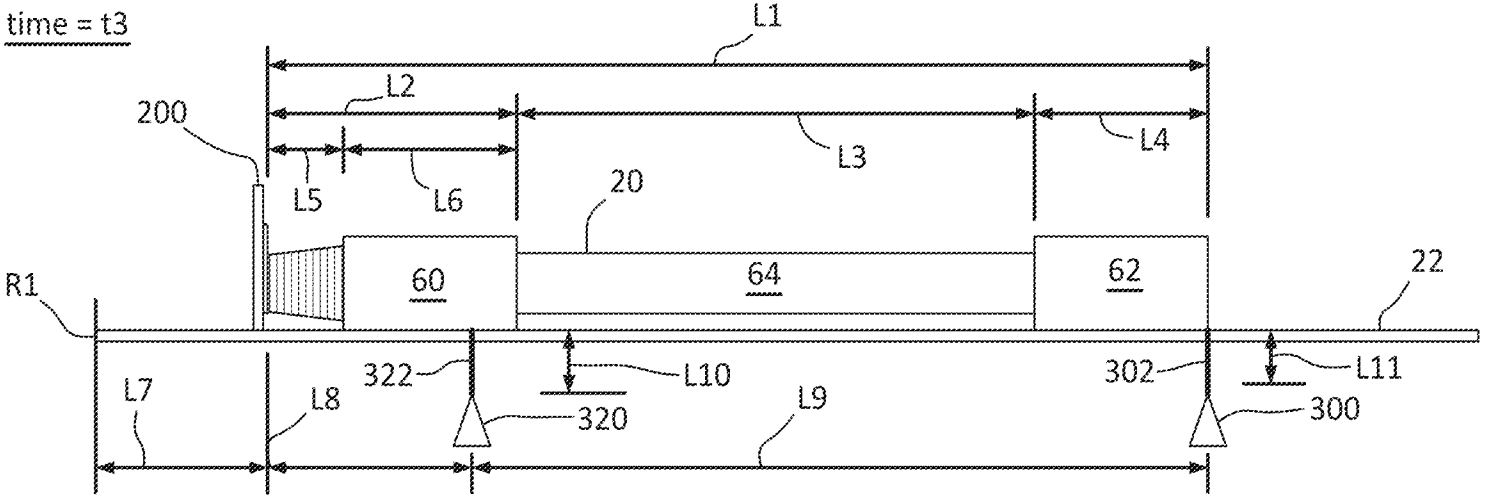

Referring to FIG. 15D, at time t3, the skate 200 has moved the tubular 20 until the leading edge of the tool joint of the box end 62 is interrupting the signal 302, thereby reducing (or beginning to reduce) the distance L11, which can be measured by the ranging sensor 300. With the leading edge of the box end 62 detected, the rig controller 250 can determine the overall distance L1 of the tubular 20 including the threaded portion of the pin end 60, which should equal distance L8+L9 at time t3.

Figure 15E:
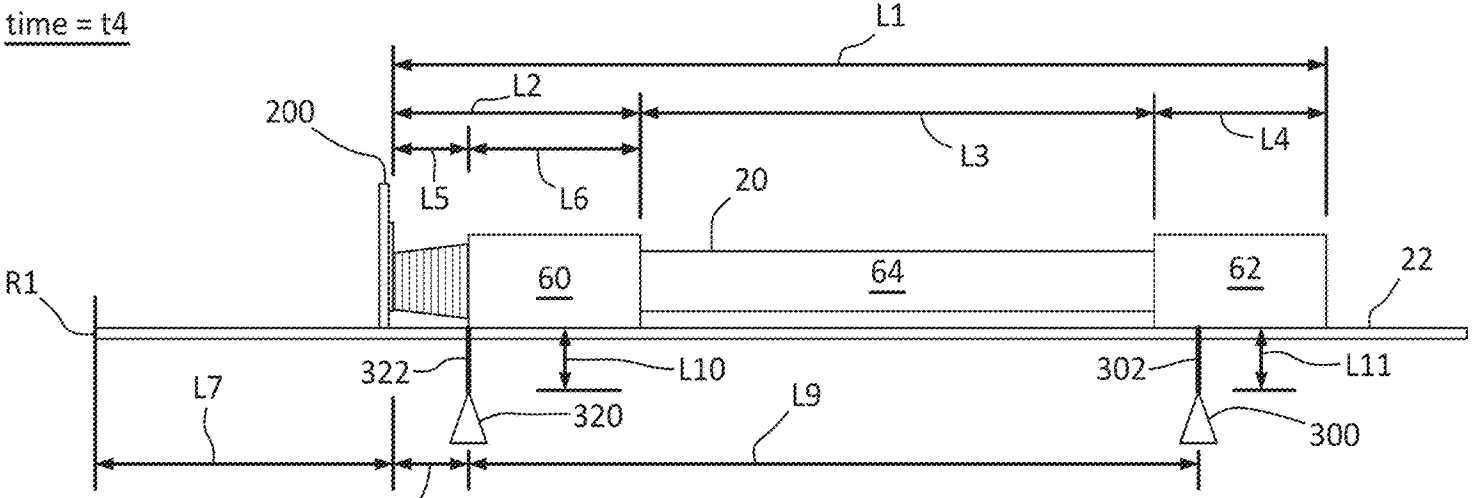

Referring to FIG. 15E, at time t4, the skate 200 has moved the tubular 20 until the trailing edge of the tool joint of the pin end 60 is interrupting the signal 322, thereby increasing (or beginning to increase) the distance L10, which can be measured by the ranging sensor 320. With the trailing edge of the pin end 60 detected, the rig controller 250 can determine the distance L5 of the threaded portion of the pin end 60 (which should equal distance L8) and the distance L6 of the tool joint of the pin end 60, which should equal distance the previously calculated distance L2 minus the distance L8 at time t4.

Figure 15F:
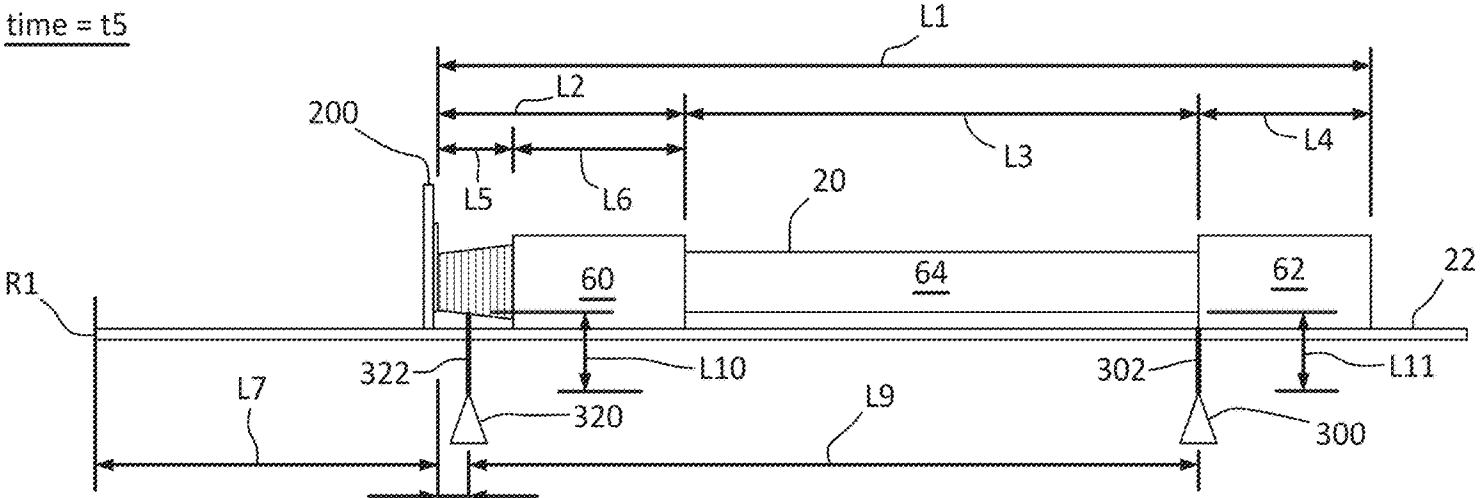

Referring to FIG. 15F, at time t5, the skate 200 has moved the tubular 20 until the trailing edge of the tool joint of the box end 62 is detected by the signal 302 being interrupted by the body 64, thereby increasing (or beginning to increase) the distance L11, which can be measured by the ranging sensor 300. With the trailing edge of the box end 62 detected, the rig controller 250 can determine the distance LA of the tool joint of the box end 62 by subtracting the distance L8+L9 at time t5 from the overall length L1. The distance L3 of the body 64 can also be determined at time t5 by subtracting the distance L2 from the distance L8+L9 at time t5.

Figure 15G:
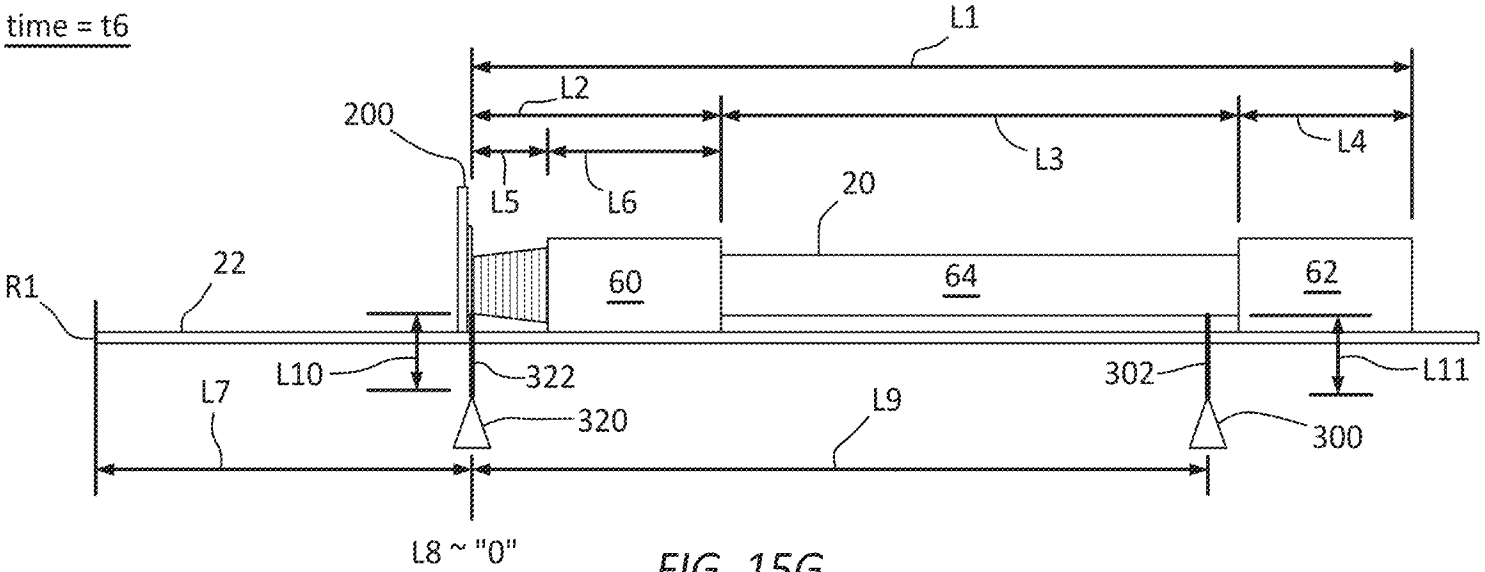

Referring to FIG. 15G, at time t6, the skate 200 has moved the tubular 20 until the trailing edge of the threaded portion of the pin end 60 (or the leading portion of the skate 200) is detected by a decrease in the distance L10, (distance L8 is ~"0" and distance L7 is the distance from the reference point R1 to the ranging sensor 320 at time t6) which can be measured by the ranging sensor 320. With the trailing edge of the threaded portion detected, the rig controller 250 can determine the slope of the threaded portion by logging the measurements of the distance L10 from the trailing edge of the tool joint for the pin end 60 and the trailing edge of the threaded portion. The change in the distance L10 can be determined and the distance L5 over which the change occurs can also be determined, which can define the slope of the threads.

Figure 16B:
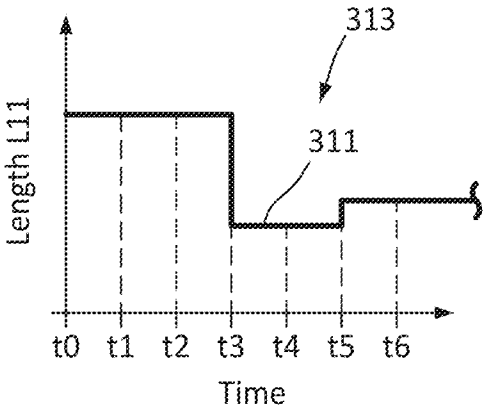
FIGS. 16A-16B are representative plots of respective outputs from ranging sensors on a carrier of a pipe handling system, in accordance with certain embodiments.
Figure 16A:
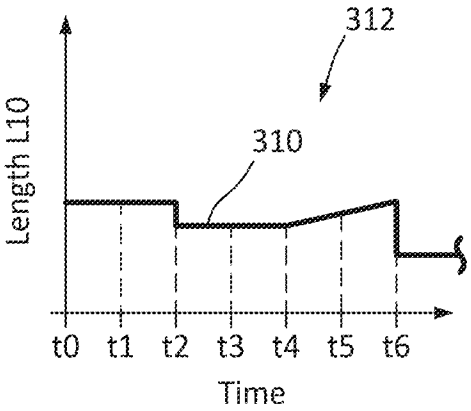

FIGS. 16A-16B are representative plots of respective outputs from ranging sensors 300, 320 on a carrier 22 of a pipe handling system 100, in accordance with certain embodiments.

FIG. 16A shows a plot 312 of the measurements of the distance L10 by the ranging sensor 320. With reference to FIGS. 15A-15G, the relative distance measurements of the distances L10 at the times t0, t1, t2, t3, t4, t5, t6 can be taken and plotted as the signal 310 in the plot 312. As can easily be seen, a profile of the outer surface of the pin end 60 can be determined by this configuration of equipment and the ranging sensor 320.

FIG. 16B shows a plot 313 of the measurements of the distance L11 by the ranging sensor 300. With reference to FIGS. 15A-15G, the relative distance measurements of the distances L11 at the times t0, t1, t2, t3, t4, t5, 16 can be taken and plotted as the signal 311 in the plot 313. As can easily be seen, a profile of the outer surface of the box end 62 can be determined by this configuration of equipment and the ranging sensor 300. Also, the various lengths L1-L6 can be determined for the tubular 20.

Figure 17:
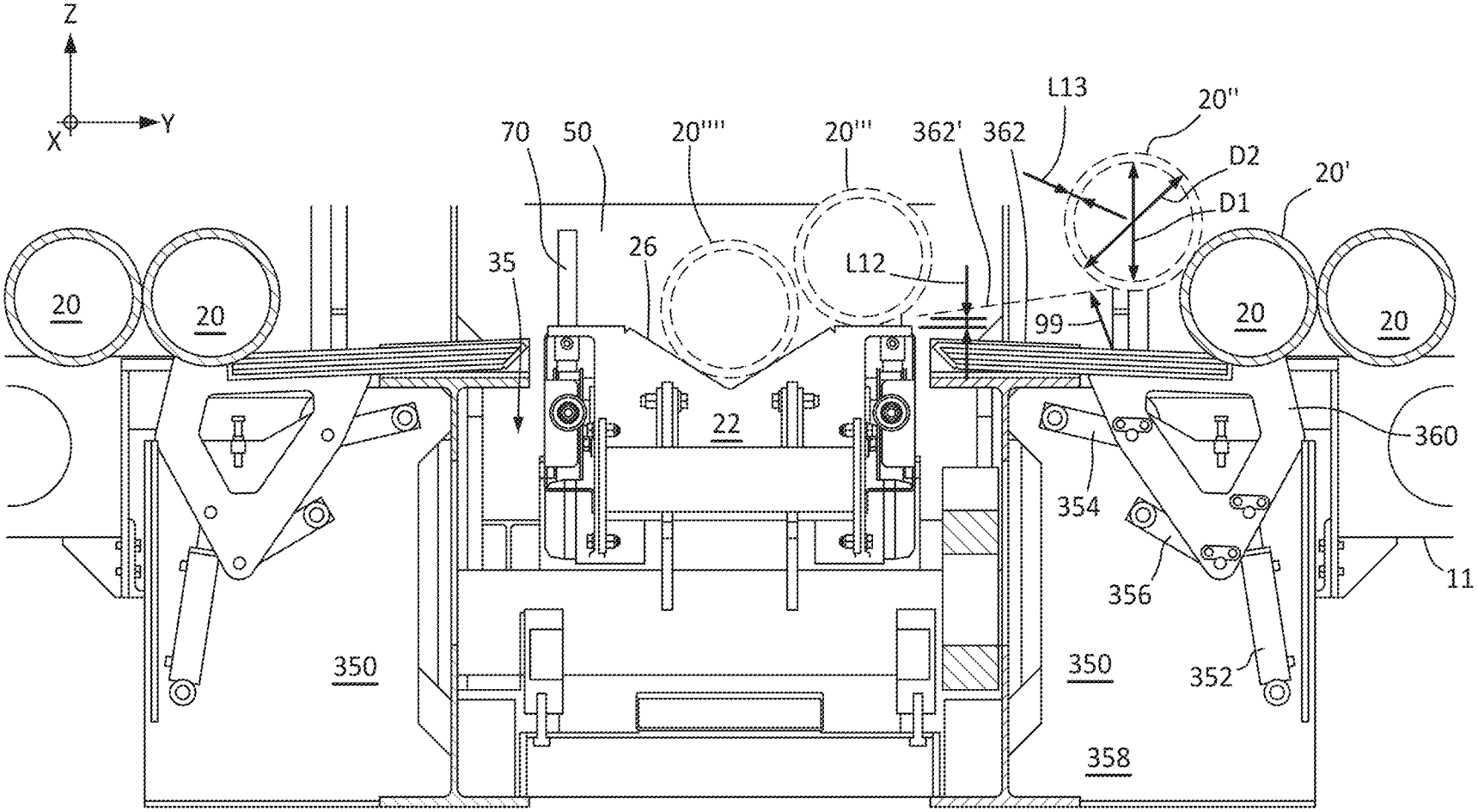
FIG. 17 is a representative partial cross-sectional side view along line 17-17, as indicated in FIG. 5A, of indexers of a pipe handling system transferring tubulars between a carrier and pipe racks, in accordance with certain embodiments.

FIG. 17 is a representative partial cross-sectional side view along line 17-17, as indicated in FIG. 5A, of indexers 350 of a pipe handling system 100 transferring tubulars 20 between a carrier 22 and pipe racks 11, in accordance with certain embodiments. As can be seen, tubulars 20 can be arranged on either side of the carrier 22 with the carrier 22 in a stowed position in the recess 35. The indexers 350 can be used to lift a tubular 20 up from the racks 11 and tip or roll the tubular 20 onto the carrier 22 and into the longitudinal V-groove 26 at position 20"".

One possible issue with some indexing systems is that they do not compensate for the different diameters of the body 64 of the tubular 20 and the tool joints. This can be seen as the distance L13, which indicates the difference between the outer diameter D1 of the body section 64 and the outer diameter D2 of the tool joint. When indexers lift the tubulars 20 by the body 64, then the tool joints can extend below the top surface of the indexers. This tool joint portion below the top surface of the indexers can interfere with the handoff from the indexers to the carrier 22. The indexers 350 of the current disclosure remedy this issue.

The tubular 20 at position 20' can be cradled by a slightly V-shaped top surface of the indexer 350 that rolls the tubular 20 to the bottom of the V-shaped top surface. The V-shaped top surface can include a top surface 362 slightly angled from a top surface 364 (see FIG. 18). It can remain in this position 20' until the indexer 350 is actuated upward (arrows 99) lifting the tubular 20 to a new position 20" with the top surface 362 of the indexer 350 (or the indexing structure 360) lifted up (to position 362') and tilted toward the carrier 22. The end of the top surface of the indexing structure 360 can be elevated above the carrier edge by a distance L12, which can be equal to or greater than the distance L13.

Therefore, when the tubular 20 rolls from the position 20" to the position 20''' the tool joint does not interfere with the transfer to the carrier 22. The tubular 20 then continues to roll into the position 20"" in the longitudinal V-groove 26 of the carrier 22. The extendable pins 70 can be used to prevent the tubular 20 from rolling past the longitudinal V-groove 26 and off the carrier 22 on the opposite side. A set of extendable pins 70 can be provided for both sides of the carrier 22 to selectively accommodate handling tubulars from either side of the carrier 22. The same operation can occur for the indexers 350 on the left side (relative to FIG. 17) of the carrier to present tubulars 20 to the carrier 22.

The indexer 350 can be actuated by extending and retracting the actuator 352, which is rotationally coupled at one end to the indexing structure 360 and at the other end to the body 358. Two link arms 354, 356 can be coupled between the body 358 and the indexing structure 360, and can cause the indexing structure 360 to be slightly rotated, thereby causing the top surface 362 to be inclined away from the carrier in the stowed position and inclined toward the carrier in the fully deployed position 362'.

Figure 18:
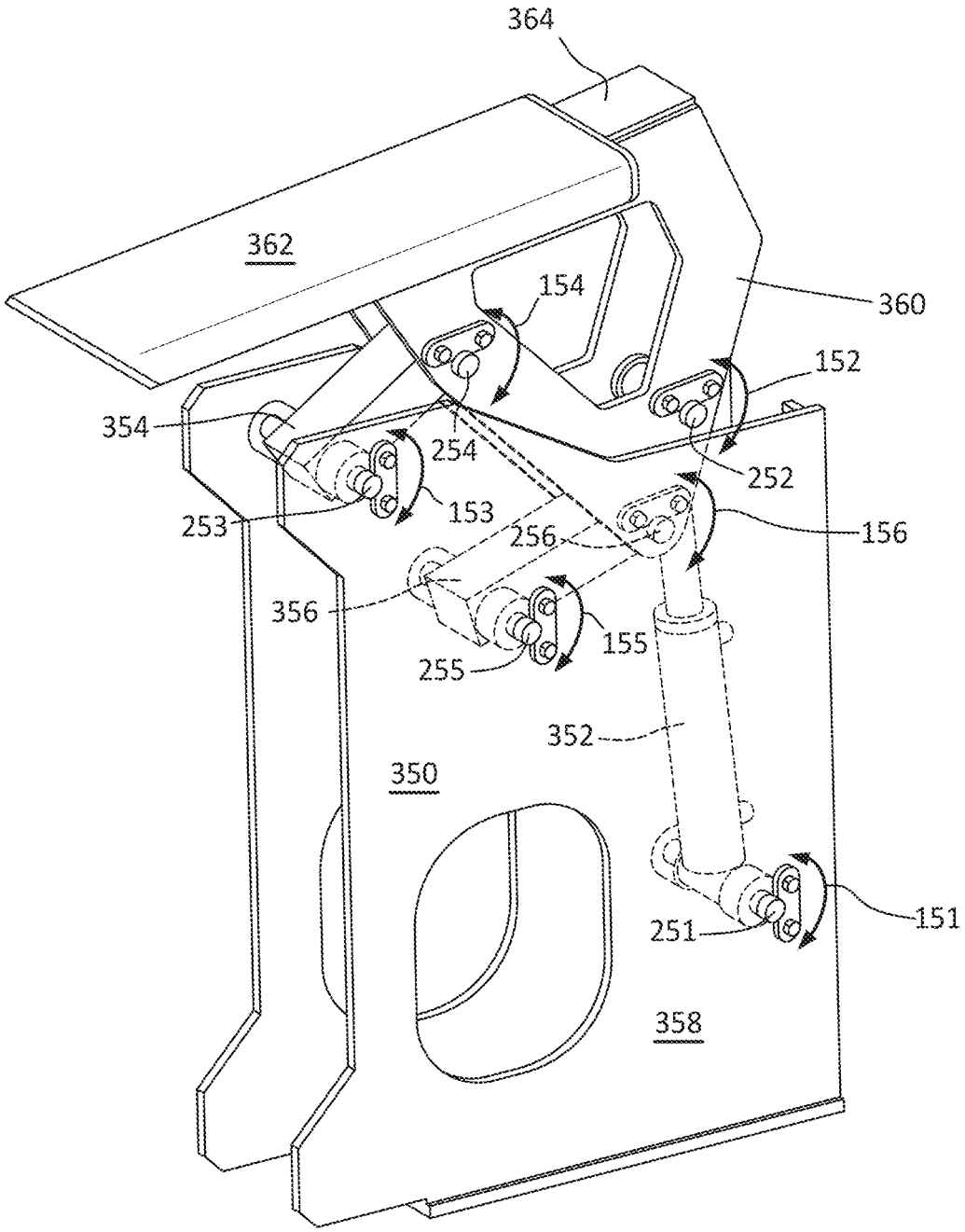
FIG. 18 is a representative perspective view of an indexer in an extended position, in accordance with certain embodiments.

FIG. 18 is a representative perspective view of an indexer 350 in a deployed position, in accordance with certain embodiments. The indexer 350 can include a body 358 that can be a hollow structure with two parallel side plates for supporting for the indexer 350 components. The actuator 352 can selectively move the indexing structure 360 between a stowed position (where the indexing structure 360 is lowered into the body 358) and a deployed position (where the indexing structure 360 is raised a desired amount from the body 358.

The indexing structure 360 can be rotationally coupled to the body via the link arms 354, 356. A first end of the link arm 354 can be rotationally coupled to the body 358 at the pivot 253 and configured to rotate (arrows 153) about the pivot 253 and a second end of the link arm 354 can be rotationally coupled to the indexing structure 360 at the pivot 254 and configured to rotate (arrows 154) about the pivot 254. A first end of the link arm 356 can be rotationally coupled to the body 358 at the pivot 255 and configured to rotate (arrows 155) about the pivot 255 and a second end of the link arm 356 can be rotationally coupled to the indexing structure 360 at the pivot 256 and configured to rotate (arrows 156) about the pivot 256.

The link arm 354 can be shorter than the link arm 356 and installed at an angle relative to the link arm 356. The difference in lengths and the relative angle between them can cause the indexing structure 360 to be rotated as it is being lifted from the stowed position, such that in the deployed position, the top surface 362 of the indexing structure 360 is tilted a desired amount toward the carrier 22 such that the tubular 20 located at the position 20' is rolled toward the carrier 22. The rotation of the indexing structure 360 also can cause the top surface 362 to be tilted away from the carrier 22 when the indexing structure 360 is in the stowed position, such that that tubular at the position 20' remains at the position 20', or a tubular 20 at a position along the top surface 362 rolls to the position 20'.

The actuator 352 can be rotationally coupled at one end to the body 358 at the pivot 251 and configured to rotate (arrows 151) about the pivot 251. The actuator 352 can be rotationally coupled at an opposite end to the body 358 at the pivot 252 and configured to rotate (arrows 152) about the pivot 252. Extension of the actuator 352 can rotate the indexing structure 360 from the stowed position to the deployed position and retraction of the actuator 352 can rotate the indexing structure 360 from the deployed position to the stowed position. With multiple indexers 350 on both sides of the base skid 40, they can be operated together to transfer tubulars between the carrier 22 and the horizontal storage area 18 on either side of the base skid 40.

Figure 19A:
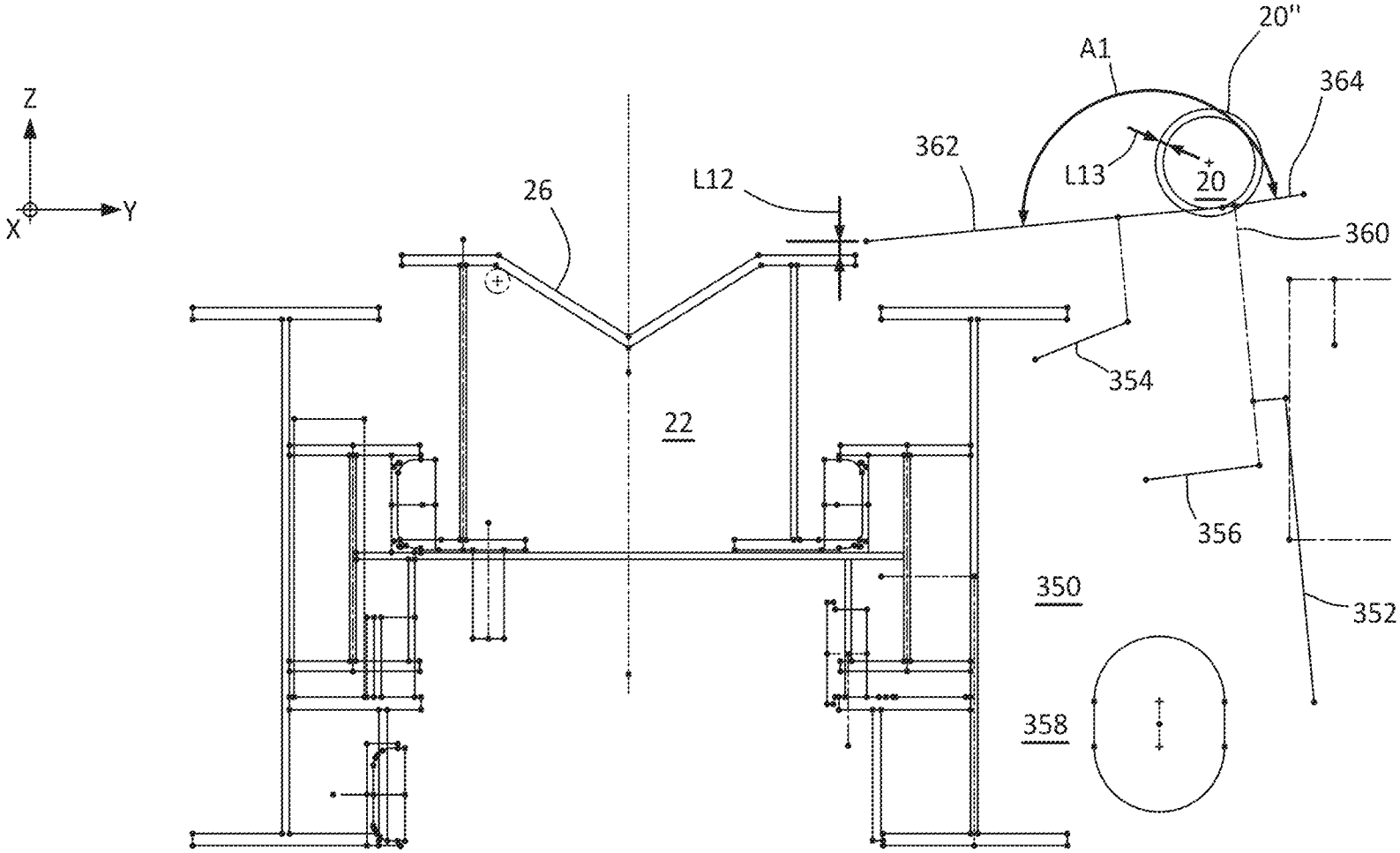
FIG. 19A-19C are representative partial cross-sectional side views along line 17-17, as indicated in FIG. 5A, of an indexer transferring tubulars from a pipe rack to a carrier, in accordance with certain embodiments.
Figure 19B:
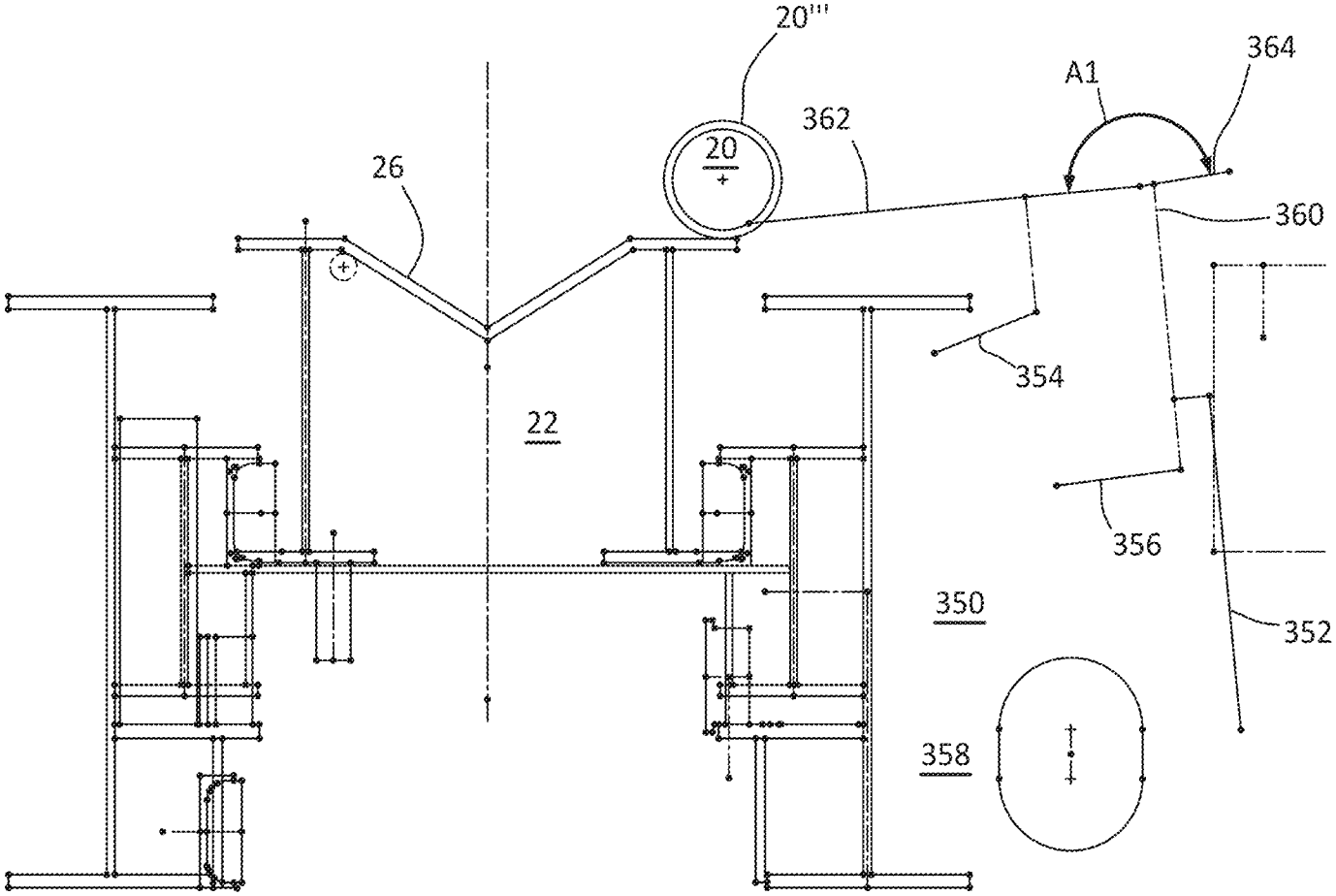
Figure 19C:
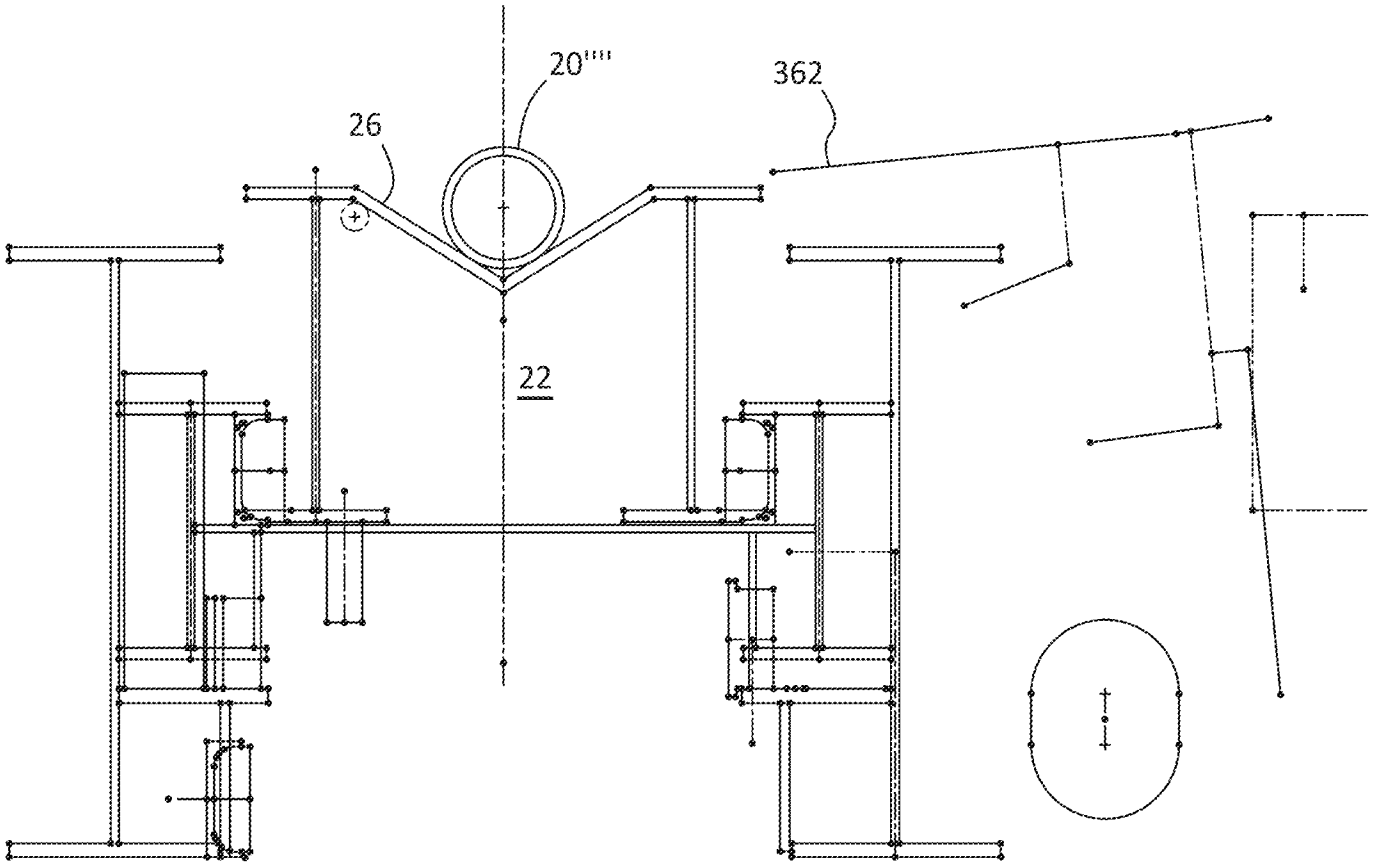

FIG. 19A-19C are representative partial cross-sectional side views along line 17-17, as indicated in FIG. 5A, of an indexer 350 transferring tubulars from a pipe rack 11 to a carrier 22, in accordance with certain embodiments. When the tubular 20 is at the position 20' (see FIG. 17), the top surfaces 362, 364 form a shallow V-shaped top surface of the indexing structure 360, such that the top surface 362 can be disposed at an angle Al relative to the top surface 364. The angle Al can be less than 180 degrees (e.g., 175 degrees, 170 degrees, etc.), thereby forming the shallow V-shaped top surface of the indexing structure 360. When the indexing structure 360 is in the stowed position, the top surface 364 is inclined toward the carrier 22 and the top surface 362, while the top surface 362 is inclined away from the carrier 22 and toward the top surface 364. This shallow V-shaped surface tends to hold the tubular 20 in the 20' position until the tubular 20 is physically moved away by operators or the indexer 350 is actuated, raising the indexing structure 360 to the deployed position.

In FIG. 19A, the actuator 352 has raised the indexing structure 360 to the deployed position with a tubular at the position 20".

In FIG. 19B, the tubular 20 has rolled down the top surface 362 of the indexing structure 360 onto the carrier without interference from the different diameters of the body 64 and the tool joint, due to the clearance length L12.

In FIG. 19C, the tubular 20 has continued to roll into the longitudinal V-groove 26 of the carrier 22. The incline of the top surface of the indexing structure 360 in the deployed position can be designed to provide enough momentum for the tubular 20 to roll into the longitudinal V-groove 26 without having enough momentum to roll on out of the longitudinal V-groove 26.

VARIOUS EMBODIMENTS

Embodiment 1. A system for handling a pipe in a subterranean operation, the system comprising:

a base skid with a longitudinal recess;

a first end of a lift arm slidably coupled to the base skid; and a carrier rotationally coupled to a second end of the lift arm, wherein the carrier is configured to move between a stowed position and a deployed position, wherein the carrier is disposed in the longitudinal recess of the base skid in the stowed position and the carrier is lifted from the longitudinal recess to the deployed position, wherein the first end of the lift arm is configured to engage a stop in the base skid while a far end of the carrier is configured to engage a first contoured surface, and wherein a direction of an inertia of the far end of the carrier is changed in response to engagement with the first contoured surface.

Embodiment 2. The system of embodiment 1, wherein the direction of the inertia of the far end is changed from a generally horizontal direction to an angled upward vertical direction in response to engagement with the first contoured surface when the carrier is moved from the stowed position to the deployed position.

Embodiment 3. The system of embodiment 1, wherein the direction of the inertia of the far end is changed from an angled downward vertical direction to a generally horizontal direction in response to engagement with the first contoured surface when the carrier is moved from the deployed position to the stowed position.

Embodiment 4. The system of embodiment 1, wherein a ramp end of the carrier is configured to engage a second contoured surface, and wherein a direction of an inertia of the ramp end of the carrier is changed in response to engagement with the second contoured surface.

Embodiment 5. The system of embodiment 4, wherein the direction of the inertia of the ramp end is changed from a generally horizontal direction to an angled upward vertical direction in response to engagement with the second contoured surface when the carrier is moved from the stowed position to the deployed position, and wherein the angled upward vertical direction is substantially parallel with an inclined ramp that is attached at an end of the base skid.

Embodiment 6. The system of embodiment 4, wherein the direction of the inertia of the ramp end is changed from an angled downward vertical direction to generally horizontal direction in response to engagement with the second contoured surface when the carrier is moved from the deployed position to the stowed position, and wherein the angled downward vertical direction is substantially parallel with an inclined ramp that is attached at an end of the base skid.

Embodiment 7. The system of embodiment 1, further comprising a ramp configured to be coupled between a rig floor and an end of the base skid.

Embodiment 8. The system of embodiment 7, wherein the lift arm vertically moves the far end of the carrier relative to the base skid when the carrier is translated toward or away from the rig floor.

Embodiment 9. The system of embodiment 7, further comprising a drive system coupled to the carrier and configured to translate a ramp end of the carrier upward along the ramp when the carrier moves from the stowed position to the deployed position, wherein the drive system is configured to translate the ramp end of the carrier downward along the ramp when the carrier moves from the deployed position to the stowed position.

Embodiment 10. The system of embodiment 9, wherein the drive system causes the lift arm to rotate upward about the stop when the ramp end of the carrier is translated upward along the ramp and the carrier moves from the stowed position to the deployed position, and wherein the drive system causes the lift arm to rotate downward about the stop when the ramp end of the carrier is translated downward along the ramp and the carrier moves from the deployed position to the stowed position.

Embodiment 11. A system for handling a pipe in a subterranean operation, the system comprising:

a base skid with a longitudinal recess;

a first end of a lift arm slidably coupled to the base skid; and a carrier rotationally coupled to a second end of the lift arm, wherein the carrier is configured to move between a stowed position and a deployed position, wherein the carrier is disposed in the longitudinal recess of the base skid in the stowed position and the carrier is lifted from the longitudinal recess to the deployed position, wherein the first end of the lift arm is configured to engage a stop in the base skid while a far end of the carrier is configured to engage a first contoured surface, and wherein the lift arm is rotated relative to the carrier in response to engagement with the first contoured surface.

Embodiment 12. The system of embodiment 11, wherein the far end of the carrier engages the first contoured surface when the carrier is lowered to the stowed position in the base skid.

Embodiment 13. A system for handling a pipe in a subterranean operation, the system comprising:

a base skid with a longitudinal recess;

a first end of a lift arm slidably coupled to the base skid; and a carrier rotationally coupled to a second end of the lift arm, wherein the carrier is configured to move between a stowed position and a deployed position, wherein the carrier is disposed in the longitudinal recess of the base skid in the stowed position and the carrier is lifted from the longitudinal recess to the deployed position, wherein the first end of the lift arm is configured to engage a stop in the base skid while a far end of the carrier is configured to engage a first contoured surface, and wherein the far end of the carrier is lifted vertically in response to engagement with the first contoured surface.

Embodiment 14. The system of embodiment 13, wherein the far end of the carrier engages the first contoured surface and follows the first contoured surface to a horizontally oriented track in the longitudinal recess of the base skid and then follows the horizontally oriented track when the carrier is lowered to the stowed position in the base skid.

Embodiment 15. A tubular management system for moving a pipe to and from a rig floor, the system comprising:

a base skid;

a ramp extendable between the base skid and the rig floor;

a carrier mounted on the base skid for moving relative thereto between a lower position and an elevated position over the ramp, the carrier including a ramp end adjacent the ramp, a far end that is opposite the ramp end, and an elongate indentation on its upper surface to accommodate a tubular therein;

a lift arm including a first end and a second end, the lift arm being pivotally connected at its first end adjacent the far end of the carrier and operable below the carrier to lift and support the far end to an elevated position;

a track in a longitudinal recess of the base skid for supporting axial motion of the carrier and the lift arm along the track, the track including a stop for limiting axial movement of the second end of the lift arm along the track toward the ramp; and a first contoured surface in the base skid that engages the far end of the carrier and lifts the far end of the carrier in response to engagement with the first contoured surface or receives the far end of the carrier and changes a direction of movement of the far end of the carrier when the far end of the carrier is lowered into the longitudinal recess.

Embodiment 16. The system of embodiment 15, further comprising a drive system configured to pull the carrier from the lower position to ride along the ramp to an elevated position, wherein the drive system is configured to pull the lift arm along the track until it engages the stop in the track and cause the lift arm to be rotated upward about the stop to lift the far end of the carrier from the longitudinal recess.

Embodiment 17. A system for detecting a presence of a pipe in a subterranean operation, the system comprising:

a base skid with a longitudinal recess;

a carrier that is configured to move between a stowed position and a deployed position, wherein the carrier is disposed in the longitudinal recess of the base skid in the stowed position and the carrier is lifted from the longitudinal recess to the deployed position;

a longitudinal V-groove formed in a top surface of the carrier;

a skate configured to engage a tubular and translate the tubular along the longitudinal V-groove; and a pipe sensor that is configured to detect an engagement of the tubular with the skate and transmit a signal that is indicative of the detection of the engagement.

Embodiment 18. The system of embodiment 17, wherein the pipe sensor comprises an engagement plate that is configured to engage the tubular and actuate an engagement sensor to indicate the engagement of the tubular with the engagement plate.

Embodiment 19. The system of embodiment 18, wherein the engagement sensor is a switch.

Embodiment 20. The system of embodiment 18, wherein the carrier is configured to wirelessly transmit the signal to a rig controller.

Embodiment 21. A system for measuring a parameter of a pipe in a subterranean operation, the system comprising:

a base skid with a longitudinal recess;

a carrier that is configured to move between a stowed position and a deployed position;

a longitudinal V-groove formed in a top surface of the carrier;

a first ranging sensor positioned along the longitudinal V-groove; and a skate configured to engage a tubular and translate the tubular along the longitudinal V-groove, wherein the first ranging sensor is configured to detect a first edge and a second edge of a first tool joint of a first end of the tubular, with the first edge longitudinally spaced away from the second edge, as the tubular is translated along the longitudinal V-groove, and wherein a rig controller is configured to determine a parameter of the tubular based on the detected first and second edges and a relative position of the skate.

Embodiment 22. The system of embodiment 21, further comprising a second ranging sensor positioned along the longitudinal V-groove and longitudinally spaced apart from the first ranging sensor.

Embodiment 23. The system of embodiment 22, wherein the second ranging sensor is configured to detect a third edge and a fourth edge of a second tool joint of a second end of the tubular, with the third edge longitudinally spaced away from the fourth edge, as the tubular is translated along the longitudinal V-groove, and wherein the rig controller is configured to determine a parameter of the tubular based on the detected third and fourth edges and the relative position of the skate.

Embodiment 24. The system of embodiment 23, wherein the parameter comprises at least one of a length of the first tool joint, a length of the second tool joint, a length of a body portion of the tubular, a length of a threaded portion of a pin end of the tubular, an overall length of the tubular, a profile of the first tool joint, a profile of the second tool joint, a profile of the threaded portion of the pin end of the tubular, or a combination thereof.

Embodiment 25. The system of embodiment 21, wherein the first ranging sensor is configured to measure a distance from the first ranging sensor to an outer surface of the tubular via a ranging signal that is transmitted by the first ranging sensor.

Embodiment 26. The system of embodiment 25, wherein the ranging sensor comprises one of a light detection and ranging (LiDAR) sensor, a time-of-flight sensor, an optical ranging sensor, a laser ranging sensor, or a combination thereof.

Embodiment 27. A method for handling tubulars during a subterranean operation, the method comprising:

disposing a carrier in a longitudinal recess in a base skid;

slidably coupling a first end of a lift arm to the base skid;

rotationally coupling a second end of the lift arm to a far end of the carrier;

translating a ramp end of the carrier along a ramp from the longitudinal recess to a rig floor;

translating the far end of the carrier along the longitudinal recess toward the ramp along with the lift arm;

engaging the first end of the lift arm with a stop in the longitudinal recess and rotating the lift arm upward, thereby lifting the far end of the carrier from the longitudinal recess; and prior to the lift arm engaging the stop, engaging the far end of the carrier with a first contoured surface that begins lifting the far end of the carrier from the longitudinal recess.

Embodiment 28. The method of embodiment 27, further comprising changing a direction of a first inertia of the far end in response to engaging the far end with the first contoured surface.

Embodiment 29. The method of embodiment 28, wherein changing the direction of the first inertia comprises changing the direction from a generally horizontal direction to an angled upward vertical direction while moving the carrier from a stowed position to a deployed position.

Embodiment 30. The method of embodiment 28, wherein changing the direction of the first inertia comprises changing the direction from an angled downward vertical direction to a generally horizontal direction while moving the carrier from a deployed position to a stowed position.

Embodiment 31. The method of embodiment 28, further comprising;

engaging a ramp end of the carrier with a second contoured surface; and changing a direction of a second inertia of the ramp end of the carrier in response to engaging the ramp end with the second contoured surface.

Embodiment 32. The method of embodiment 31, wherein changing the direction of the second inertia of the ramp end is changed from a generally horizontal direction to an angled upward vertical direction while moving the carrier from a stowed position to a deployed position, and wherein the angled upward vertical direction is substantially parallel with the ramp.

Embodiment 33. The method of embodiment 31, wherein changing the direction of the second inertia of the ramp end is changed from an angled downward vertical direction to a generally horizontal direction in response to engagement with the second contoured surface while moving the carrier from a deployed position to a stowed position, and wherein the angled downward vertical direction is substantially parallel with the ramp.

Embodiment 34. The method of embodiment 27, further comprising rotating the lift arm vertically and thereby moving the far end of the carrier relative to the base skid while moving the carrier between a stowed position and a deployed position.

Embodiment 35. The method of embodiment 27, further comprising:

translating the ramp end of the carrier, via a drive system coupled to the carrier, upward along the ramp when the carrier moves from a stowed position to a deployed position; and translating the ramp end of the carrier, via the drive system coupled to the carrier, downward along the ramp when the carrier moves from the deployed position to the stowed position.

Embodiment 36. The method of embodiment 35, further comprising:

rotating the lift arm upward about the stop in response to the drive system translating the ramp end of the carrier upward along the ramp when the carrier moves from a stowed position to a deployed position; and rotating the lift arm downward about the stop in response to the drive system translating the ramp end of the carrier downward along the ramp when the carrier moves from the deployed position to the stowed position.

Embodiment 37. A system for measuring a parameter of a pipe in a subterranean operation, the system comprising:

a base skid with a longitudinal recess;

a carrier that is configured to move between a stowed position and a deployed position;

a longitudinal V-groove formed in a top surface of the carrier; and a ranging sensor positioned along the longitudinal V-groove, wherein the ranging sensor is configured to detect a first edge and a second edge of an end of a tubular, with the first edge longitudinally spaced away from the second edge, as the tubular is translated along the longitudinal V-groove, wherein a rig controller is configured to determine a parameter of the tubular based on the detected first and second edges, wherein the parameter comprises a profile of the end of the tubular.

Embodiment 38. The system of embodiment 37, wherein the end of the tubular comprises a tool joint or a coupling for casing.

Embodiment 39. The system of embodiment 37, further comprising a skate configured to engage the tubular and translate the tubular along the longitudinal V-groove, wherein a rig controller is configured to determine the parameter of the tubular based on the detected first and second edges and a relative position of the skate.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A system for performing a subterranean operation, the system comprising:

a base skid with a longitudinal recess;

a carrier configured to transport a tubular, wherein the carrier is configured to move between a stowed position with the carrier being in the longitudinal recess and a deployed position with the carrier being outside of the longitudinal recess, wherein a wheel at a far end of the carrier is configured to engage a first contoured surface, and wherein a direction of an inertia of the far end of the carrier is changed in response to engagement of the wheel with the first contoured surface; and a lift arm with first and second ends, the first end being rotationally coupled to the carrier at a position on the carrier that is spaced away from the wheel, and the second end being slidably coupled to the base skid.

2. The system of claim 1, wherein the direction of the inertia of the far end is changed from a generally horizontal direction to an angled upward direction in response to engagement with the first contoured surface when the carrier is moved from the stowed position to the deployed position.

3. The system of claim 1, wherein the direction of the inertia of the far end is changed from an angled downward direction to a generally horizontal direction in response to engagement with the first contoured surface when the carrier is moved from the deployed position to the stowed position.

4. The system of claim 1, wherein a ramp end of the carrier is configured to engage a second contoured surface, and wherein a direction of an inertia of the ramp end of the carrier is changed in response to engagement with the second contoured surface.

5. The system of claim 1, further comprising a ramp configured to be coupled between a rig floor and an end of the base skid.

6. The system of claim 5, wherein the lift arm vertically moves the far end of the carrier relative to the base skid when the carrier is translated toward or away from the rig floor.

7. The system of claim 5, further comprising a cable drive coupled to the carrier wherein the cable drive translates a ramp end of the carrier upward along the ramp when the carrier moves from the stowed position to the deployed position, and wherein the cable drive translates the ramp end of the carrier downward along the ramp when the carrier moves from the deployed position to the stowed position.

8. The system of claim 7, wherein the cable drive causes the lift arm to rotate upward about a stop in the base skid as the ramp end of the carrier is translated upward along the ramp and the carrier moves from the stowed position to the deployed position.

9. The system of claim 7, wherein the cable drive causes the lift arm to rotate downward about a stop in the base skid as the ramp end of the carrier is translated downward along the ramp and the carrier moves from the deployed position to the stowed position.

10. The system of claim 1, wherein the lift arm is rotated relative to the carrier in response to the engagement with the first contoured surface.

11. The system of claim 1, wherein the far end of the carrier engages the first contoured surface as the carrier is lowered into the longitudinal recess in the base skid.

12. The system of claim 1, wherein the far end of the carrier is lifted vertically in response to the engagement of the wheel with the first contoured surface.

13. The system of claim 1, wherein the wheel of the carrier engages the first contoured surface and follows the first contoured surface downward to a horizontally oriented track as the far end is lowered into the longitudinal recess.

14. A method for performing a subterranean operation, the method comprising:

disposing a carrier in a longitudinal recess in a base skid;

translating a ramp end of the carrier along a ramp from the longitudinal recess to a rig floor;

translating a far end of the carrier and a lift arm coupled to the carrier along the longitudinal recess toward the ramp, wherein a first end of the lift arm is rotationally coupled to the carrier adjacent the far end of the carrier and a second end of the lift arm is slidably coupled to the longitudinal recess; and engaging a wheel at the far end of the carrier with a first contoured surface, wherein the wheel is positioned at the far end of the carrier and spaced away from the first end of the lift arm, and wherein engaging the wheel with the first contoured surface begins to lift the far end of the carrier from the longitudinal recess.

15. The method of claim 14, further comprising changing a direction of a first inertia of the far end in response to engaging the wheel with the first contoured surface.

16. The method of claim 15, wherein changing the direction of the first inertia comprises changing the direction from a generally horizontal direction to an angled upward direction while moving the carrier from a stowed position to a deployed position.

17. The method of claim 15, wherein changing the direction of the first inertia comprises changing the direction from an angled downward direction to a generally horizontal direction while moving the carrier from a deployed position to a stowed position.

18. The method of claim 14, further comprising rotating the lift arm vertically and thereby moving the far end of the carrier upward relative to the base skid while moving the carrier between a stowed position and a deployed position.

19. The method of claim 14, further comprising:

translating the ramp end of the carrier, via a cable drive coupled to the carrier, upward along the ramp when the carrier moves from a stowed position to a deployed position; and translating the ramp end of the carrier, via the cable drive, downward along the ramp when the carrier moves from the deployed position to the stowed position.

20. The method of claim 19, further comprising:

engaging an end of the lift arm with a stop in the longitudinal recess and rotating the lift arm upward, thereby lifting the far end of the carrier from the longitudinal recess;

rotating the lift arm upward about the stop in response to the cable drive translating the ramp end of the carrier upward along the ramp when the carrier moves from the stowed position to the deployed position; and rotating the lift arm downward about the stop in response to the cable drive translating the ramp end of the carrier downward along the ramp when the carrier moves from the deployed position to the stowed position.

* * * * *